US009743701B2

(12) United States Patent
Javorek et al.

(10) Patent No.: US 9,743,701 B2
(45) **Date of Patent: *Aug. 29, 2017**

(54) HELMET RETENTION SYSTEM

(71) Applicant: INTELLECTUAL PROPERTY HOLDINGS, LLC, Cleveland, OH (US)

(72) Inventors: Bryan Stephen Javorek, Lyndhurst, OH (US); Ron Szalkowski, Lakewood, OH (US); Joshua Schmidt, Lakewood, OH (US)

(73) Assignee: Intellectual Property Holdings, LLC, Cleveland, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/524,675

(22) Filed: Oct. 27, 2014

(65) Prior Publication Data

US 2015/0305429 A1 Oct. 29, 2015

Related U.S. Application Data

(60) Provisional application No. 61/896,221, filed on Oct. 28, 2013.

(51) Int. Cl.
*A42B 3/08* (2006.01)
*A42B 3/14* (2006.01)

(52) U.S. Cl.
CPC ..... *A42B 3/085* (2013.01); *A42B 3/08* (2013.01); *A42B 3/145* (2013.01)

(58) Field of Classification Search
CPC ..... A42B 3/085; A42B 3/08; A42B 3/145; A42B 3/147

(Continued)

(56) References Cited

U.S. PATENT DOCUMENTS 666,130 A 1/1901 Cole
957,394 A 5/1910 Thoma
(Continued)

FOREIGN PATENT DOCUMENTS

CA 2598015 8/2006
CA 2663728 9/2008
(Continued)

OTHER PUBLICATIONS

European search report from EP Application No. 13844406 dated Jul. 10, 2015.

(Continued)

*Primary Examiner* — Jameson Collier
*Assistant Examiner* — Heather Mangine
(74) *Attorney, Agent, or Firm* — Calfee, Halter & Griswold LLP

(57) ABSTRACT

The present application discloses a helmet, a helmet retention system, and a method of adjusting a helmet. In certain embodiments, the helmet comprises a helmet shell and a helmet retention system. The retention system comprises a rear portion connected to the rear of the helmet shell, first and second straps extending from the rear portion to a front portion of the helmet shell, and an adjustment device attached to the rear portion for adjusting the length of the first and second straps between the rear portion and the front portion of the helmet shell to tighten and loosen the straps about the head of the user. Each strap comprises a strap segment and an elongated member attached to the strap segment. The adjustment device is configured to selectively adjust the elongated member to move the first and second strap segments relative to the helmet shell.

36 Claims, 14 Drawing Sheets

(58) Field of Classification Search
USPC ..... 2/421, 417, 418, 419, 420
See application file for complete search history.

(56) References Cited

U.S. PATENT DOCUMENTS

| | | | |
|---|---|---|---|
| 1,012,597 | A | 12/1911 | Church |
| 1,539,283 | A | 5/1925 | Staats-Oels |
| 1,552,965 | A | 9/1925 | Smith |
| 1,560,825 | A | 11/1925 | Kelticka |
| 1,958,050 | A | 5/1934 | Koppelman |
| 2,074,331 | A | 3/1937 | Haider |
| 2,090,881 | A | 8/1937 | Wilson |
| 2,221,310 | A | 11/1940 | Gazelle |
| 2,275,575 | A | 3/1942 | Vrooman |
| 2,285,335 | A | 6/1942 | Hurt |
| 2,303,744 | A | 12/1942 | Jacobs |
| 2,311,373 | A | 2/1943 | Durning |
| 2,318,077 | A | 5/1943 | Jonas |
| 2,346,161 | A | 4/1944 | Grant |
| 2,349,907 | A | 5/1944 | Kos |
| 2,433,012 | A | 12/1947 | Zalicovitz |
| 2,434,641 | A | 1/1948 | Burns |
| 2,649,019 | A | 8/1953 | Hartline |
| 2,711,033 | A | 6/1955 | Dick |
| 2,739,093 | A | 3/1956 | Bull |
| 2,759,186 | A | 8/1956 | Dye |
| 2,772,196 | A | 11/1956 | Pooley |
| 2,776,452 | A | 1/1957 | Chavannes |
| 2,983,056 | A | 5/1961 | Murawski |
| 3,018,015 | A | 1/1962 | Agriss et al. |
| 3,026,231 | A | 3/1962 | Chavannes |
| 3,039,109 | A | 6/1962 | Simpson |
| 3,086,899 | A | 4/1963 | Smith et al. |
| 3,088,539 | A | 5/1963 | Mathues et al. |
| 3,099,043 | A | 7/1963 | Held |
| 3,124,807 | A | 3/1964 | Frenkel et al. |
| 3,142,599 | A | 7/1964 | Chavannes |
| 3,144,247 | A | 8/1964 | Szonn et al. |
| 3,153,792 | A | 10/1964 | Marietta |
| 3,160,963 | A | 12/1964 | Aaskov |
| 3,186,013 | A | 6/1965 | Glassman et al. |
| 3,195,686 | A | 7/1965 | Johnson |
| 3,231,454 | A | 1/1966 | Williams |
| 3,242,500 | A | 3/1966 | Derr |
| 3,251,076 | A | 5/1966 | Burke |
| 3,280,410 | A | 10/1966 | Propst et al. |
| 3,327,334 | A | 6/1967 | Wilmanns et al. |
| 3,342,666 | A | 9/1967 | Hull |
| 3,366,971 | A | 2/1968 | Scherz |
| 3,378,888 | A | 4/1968 | Robertson |
| 3,425,061 | A | 2/1969 | Webb |
| 3,447,163 | A | 6/1969 | Bothwell et al. |
| 3,484,835 | A | 12/1969 | Trountine et al. |
| 3,500,472 | A | 3/1970 | Castellani |
| 3,500,475 | A | 3/1970 | Otsuka |
| 3,507,727 | A | 4/1970 | Marshack |
| 3,508,992 | A | 4/1970 | Chavannes et al. |
| 3,514,156 | A | 5/1970 | Fields |
| 3,525,663 | A | 8/1970 | Hale |
| 3,538,628 | A | 11/1970 | Einstein, Jr. |
| 3,575,781 | A | 4/1971 | Pezely |
| 3,600,714 | A | 8/1971 | Cade |
| 3,608,215 | A | 9/1971 | Fukuoka |
| 3,609,764 | A | 10/1971 | Morgan |
| 3,618,144 | A | 11/1971 | Frey et al. |
| 3,633,228 | A | 1/1972 | Zysman |
| 3,668,056 | A | 6/1972 | Hayes, Jr. |
| 3,668,704 | A | 6/1972 | Conroy |
| 3,673,609 | A | 7/1972 | De Simone |
| 3,679,166 | A | 7/1972 | Sturhan |
| 3,684,235 | A | 8/1972 | Schupbach |
| 3,709,967 | A | 1/1973 | Edward, Jr. |
| 3,713,640 | A | 1/1973 | Margan |
| 3,716,614 | A | 2/1973 | Okamoto et al. |
| 3,729,744 | A | 5/1973 | Rappleyea |
| 3,747,968 | A | 7/1973 | Hornsby |
| 3,761,959 | A | 10/1973 | Dunning |
| 3,766,669 | A | 10/1973 | Pearsall |
| 3,782,767 | A | 1/1974 | Moore |
| 3,783,450 | A | 1/1974 | O'Connor |
| 3,784,985 | A | 1/1974 | Conroy |
| 3,806,950 | A | 4/1974 | Spencer-Foote |
| 3,837,991 | A | 9/1974 | Evans |
| 3,844,862 | A | 10/1974 | Sauer et al. |
| 3,849,801 | A | 11/1974 | Holt et al. |
| 3,853,221 | A | 12/1974 | Boyd |
| 3,857,144 | A | 12/1974 | Bustin |
| 3,863,909 | A | 2/1975 | Weber |
| 3,871,636 | A | 3/1975 | Boyle |
| 3,872,511 | A | 3/1975 | Nichols |
| 3,877,076 | A | 4/1975 | Summers |
| 3,882,547 | A | 5/1975 | Morgan |
| 3,895,456 | A | 7/1975 | Fabre |
| 3,900,222 | A | 8/1975 | Muller |
| 3,911,187 | A | 10/1975 | Raley |
| 3,926,463 | A | 12/1975 | Landwehr |
| 3,928,881 | A | 12/1975 | Bente |
| 3,933,387 | A | 1/1976 | Salloum et al. |
| 3,940,529 | A | 2/1976 | Hepford et al. |
| 3,940,811 | A | 3/1976 | Tomikawa et al. |
| 3,952,358 | A | 4/1976 | Fukuoka |
| 3,971,583 | A | 7/1976 | Kornhauser |
| D241,228 | S | 8/1976 | Boduch |
| 3,994,020 | A | 11/1976 | Villari |
| 3,995,901 | A | 12/1976 | Filbert, Jr. et al. |
| 3,997,207 | A | 12/1976 | Norlin |
| 3,999,220 | A | 12/1976 | Keltner |
| 4,022,505 | A | 5/1977 | Saczawa, Jr. |
| 4,023,213 | A | 5/1977 | Rovani |
| 4,029,350 | A | 6/1977 | Goupy et al. |
| 4,029,534 | A | 6/1977 | Bocks et al. |
| 4,038,700 | A | 8/1977 | Gyory |
| 4,044,399 | A | 8/1977 | Morton |
| 4,044,479 | A | 8/1977 | Brutting |
| 4,064,565 | A | 12/1977 | Griffiths |
| 4,067,063 | A | 1/1978 | Ettinger |
| 4,075,717 | A | 2/1978 | Lemelson |
| 4,077,393 | A | 3/1978 | Mattson |
| 4,099,759 | A | 7/1978 | Kornhauser |
| 4,101,983 | A | 7/1978 | Dera et al. |
| 4,106,745 | A | 8/1978 | Carrow |
| 4,110,857 | A | 9/1978 | Banister |
| 4,114,197 | A | 9/1978 | Morton |
| 4,134,156 | A | 1/1979 | Gyory |
| 4,151,661 | A | 5/1979 | Namba |
| 4,154,469 | A | 5/1979 | Goupy et al. |
| 4,154,489 | A | 5/1979 | Lyman |
| 4,170,078 | A | 10/1979 | Moss |
| 4,187,620 | A | 2/1980 | Selner |
| 4,190,276 | A | 2/1980 | Hirano |
| 4,192,699 | A | 3/1980 | Lewicki et al. |
| 4,213,202 | A | 7/1980 | Larry |
| 4,223,455 | A | 9/1980 | Vermeulen |
| 4,223,456 | A | 9/1980 | Cohen |
| 4,236,326 | A | 12/1980 | Inohara |
| 4,239,476 | A | 12/1980 | Somberg |
| 4,251,932 | A | 2/1981 | Love |
| 4,262,433 | A | 4/1981 | Hagg |
| 4,267,648 | A | 5/1981 | Weisz |
| 4,279,038 | A | 7/1981 | Bruckner et al. |
| 4,287,613 | A | 9/1981 | Schulz |
| 4,288,399 | A | 9/1981 | Siedenstrang et al. |
| 4,290,149 | A | 9/1981 | Aileo |
| 4,297,797 | A | 11/1981 | Meyers |
| 4,299,038 | A | 11/1981 | Epple |
| 4,302,892 | A | 12/1981 | Adamik |
| 4,305,212 | A | 12/1981 | Coomer |
| 4,307,471 | A | 12/1981 | Lovell |
| 4,321,989 | A | 3/1982 | Meinzer |
| 4,338,371 | A | 7/1982 | Dawn et al. |
| 4,342,157 | A | 8/1982 | Gilbert |
| 4,342,158 | A | 8/1982 | McMahon |
| 4,345,338 | A | 8/1982 | Frieder, Jr. et al. |
| 4,347,637 | A | 9/1982 | Ardito |

(56) References Cited

U.S. PATENT DOCUMENTS

| | | | |
|---|---|---|---|
| 4,352,484 | A | 10/1982 | Gertz |
| 4,355,792 | A | 10/1982 | Fukuda |
| 4,356,642 | A | 11/1982 | Herman |
| D267,287 | S | 12/1982 | Gooding |
| D267,831 | S | 2/1983 | Sucato |
| 4,370,754 | A | 2/1983 | Donzis |
| 4,372,058 | A | 2/1983 | Stubblefield |
| 4,377,042 | A | 3/1983 | Bauer |
| 4,391,048 | A | 7/1983 | Lutz |
| 4,398,357 | A | 8/1983 | Batra |
| 4,400,483 | A | 8/1983 | Siedenstrang et al. |
| 4,400,894 | A | 8/1983 | Ehrlich |
| 4,413,856 | A | 11/1983 | McMahan et al. |
| 4,418,483 | A | 12/1983 | Fujita |
| 4,423,000 | A | 12/1983 | Teraoka |
| 4,428,306 | A | 1/1984 | Dresen et al. |
| 4,432,099 | A | 2/1984 | Grick et al. |
| 4,439,936 | A | 4/1984 | Clarke et al. |
| 4,445,283 | A | 5/1984 | Meyers |
| 4,449,307 | A | 5/1984 | Stubblefield |
| 4,453,271 | A | 6/1984 | Donzis |
| 4,455,765 | A | 6/1984 | Sjosward |
| 4,458,430 | A | 7/1984 | Peterson |
| 4,460,205 | A | 7/1984 | Glance |
| 4,461,044 | A | 7/1984 | Reiterman |
| 4,472,472 | A | 9/1984 | Schultz |
| 4,494,320 | A | 1/1985 | Davis |
| 4,497,123 | A | 2/1985 | Ehrlich |
| 4,510,702 | A | 4/1985 | Ehrlich, Jr. |
| 4,513,449 | A | 4/1985 | Donzis |
| 4,518,643 | A | 5/1985 | Francis |
| 4,523,393 | A | 6/1985 | Inohara |
| 4,534,068 | A | 8/1985 | Mitchell et al. |
| 4,535,553 | A | 8/1985 | Derderian et al. |
| 4,538,301 | A | 9/1985 | Sawatzki et al. |
| 4,538,366 | A | 9/1985 | Norton |
| 4,546,555 | A | 10/1985 | Spademan |
| 4,553,342 | A | 11/1985 | Derderian et al. |
| 4,558,470 | A | 12/1985 | Mitchell et al. |
| 4,562,651 | A | 1/1986 | Frederick et al. |
| 4,566,137 | A | 1/1986 | Gooding |
| 4,566,678 | A | 1/1986 | Anderson |
| 4,578,296 | A | 3/1986 | Miyazaki |
| 4,586,200 | A | 5/1986 | Poon |
| 4,601,367 | A | 7/1986 | Bongers |
| 4,614,000 | A | 9/1986 | Mayer |
| 4,616,431 | A | 10/1986 | Dassler |
| 4,619,055 | A | 10/1986 | Davidson |
| 4,624,061 | A | 11/1986 | Wezel et al. |
| 4,627,114 | A | 12/1986 | Mitchell |
| 4,631,221 | A | 12/1986 | Disselbeck et al. |
| 4,635,384 | A | 1/1987 | Huh et al. |
| 4,635,981 | A | 1/1987 | Friton |
| 4,642,814 | A | 2/1987 | Godfrey |
| 4,657,716 | A | 4/1987 | Schmidt |
| 4,667,423 | A | 5/1987 | Autry et al. |
| 4,670,995 | A | 6/1987 | Huang |
| 4,672,754 | A | 6/1987 | Ehrlich |
| 4,676,010 | A | 6/1987 | Cheskin |
| 4,680,875 | A | 7/1987 | DAnieli |
| 4,695,496 | A | 9/1987 | Lee |
| 4,700,403 | A | 10/1987 | Vacanti |
| 4,703,879 | A | 11/1987 | Kastendieck |
| 4,704,746 | A | 11/1987 | Nava |
| 4,710,984 | A | 12/1987 | Asper |
| 4,720,261 | A | 1/1988 | Fishwick et al. |
| 4,722,131 | A | 2/1988 | Huang |
| 4,724,549 | A | 2/1988 | Herder et al. |
| 4,730,402 | A | 3/1988 | Norton et al. |
| 4,739,762 | A | 4/1988 | Palmaz |
| 4,741,114 | A | 5/1988 | Stubblefield |
| 4,753,021 | A | 6/1988 | Cohen |
| 4,759,136 | A | 7/1988 | Stewart et al. |
| 4,763,426 | A | 8/1988 | Polus et al. |
| 4,766,614 | A | 8/1988 | Cantwell et al. |
| 4,768,295 | A | 9/1988 | Ito |
| 4,798,009 | A | 1/1989 | Colonel et al. |
| 4,808,469 | A | 2/1989 | Hiles |
| 4,815,221 | A | 3/1989 | Diaz |
| 4,817,304 | A | 4/1989 | Parker et al. |
| 4,823,483 | A | 4/1989 | Chapncik |
| 4,831,750 | A | 5/1989 | Muller |
| 4,838,606 | A | 6/1989 | Furubayashi et al. |
| 4,842,931 | A | 6/1989 | Zook |
| 4,843,741 | A | 7/1989 | Yung-Mao |
| 4,844,213 | A | 7/1989 | Travis |
| 4,845,786 | A | 7/1989 | Chiarella |
| 4,845,861 | A | 7/1989 | Moumdjian |
| 4,845,863 | A | 7/1989 | Yung-Mao |
| 4,852,704 | A | 8/1989 | Brockenbrough |
| 4,853,980 | A | 8/1989 | Zarotti |
| 4,856,208 | A | 8/1989 | Zaccaro |
| 4,856,833 | A | 8/1989 | Beekman |
| 4,858,343 | A | 8/1989 | Flemming |
| 4,858,606 | A | 8/1989 | Hamlin |
| 4,872,220 | A | 10/1989 | Haruvy et al. |
| 4,876,053 | A | 10/1989 | Norton |
| 4,883,299 | A | 11/1989 | Bonar |
| 4,887,369 | A | 12/1989 | Bailey |
| 4,890,877 | A | 1/1990 | Ashtiani-Zarandi et al. |
| 4,899,467 | A | 2/1990 | Mackey |
| 4,901,987 | A | 2/1990 | Greenhill et al. |
| 4,904,008 | A | 2/1990 | Glance |
| 4,905,382 | A | 3/1990 | Yung-Mao |
| 4,909,661 | A | 3/1990 | Ivey |
| 4,912,861 | A | 4/1990 | Huang |
| 4,916,759 | A | 4/1990 | Arai |
| 4,918,841 | A | 4/1990 | Turner |
| 4,920,663 | A | 5/1990 | Flemming |
| 4,922,630 | A | 5/1990 | Robinson |
| 4,922,631 | A | 5/1990 | Anderie |
| 4,923,650 | A | 5/1990 | Antoon, Jr. et al. |
| 4,925,224 | A | 5/1990 | Smiszek |
| 4,930,231 | A | 6/1990 | Liu |
| 4,931,115 | A | 6/1990 | Pajunen |
| 4,934,071 | A | 6/1990 | Virgini |
| 4,941,701 | A | 7/1990 | Loren |
| 4,951,986 | A | 8/1990 | Hanafusa et al. |
| D310,893 | S | 9/1990 | Broersma |
| 4,969,680 | A | 11/1990 | Shimoda |
| 4,970,729 | A | 11/1990 | Shimazaki |
| 4,972,611 | A | 11/1990 | Swartz |
| 4,984,320 | A | 1/1991 | Curley, Jr. et al. |
| 4,987,609 | A | 1/1991 | Zahn |
| 4,993,173 | A | 2/1991 | Gardener |
| 4,999,931 | A | 3/1991 | Vermeulen |
| 5,011,642 | A | 4/1991 | Welygan et al. |
| 5,014,449 | A | 5/1991 | Richard et al. |
| 5,014,691 | A | 5/1991 | Cueman et al. |
| 5,016,417 | A | 5/1991 | Mentken |
| 5,025,504 | A | 6/1991 | Benston et al. |
| 5,027,803 | A | 7/1991 | Scholz et al. |
| 5,030,501 | A | 7/1991 | Colvin et al. |
| 5,033,593 | A | 7/1991 | Kazuhito |
| 5,035,009 | A | 7/1991 | Wingo, Jr. et al. |
| 5,035,758 | A | 7/1991 | Degler et al. |
| 5,042,174 | A | 8/1991 | Nichols |
| 5,042,175 | A | 8/1991 | Romen et al. |
| 5,042,176 | A | 8/1991 | Rudy |
| 5,042,859 | A | 8/1991 | Zhang et al. |
| 5,044,096 | A | 9/1991 | Polegato |
| 5,046,267 | A | 9/1991 | Kilgore et al. |
| 5,048,203 | A | 9/1991 | Kling |
| 5,056,162 | A | 10/1991 | Tirums |
| 5,058,212 | A | 10/1991 | Kamata |
| 5,066,400 | A | 11/1991 | Rocklitz et al. |
| 5,068,922 | A | 12/1991 | Zahn |
| 5,083,320 | A | 1/1992 | Halstead |
| 5,083,361 | A | 1/1992 | Rudy |
| 5,086,033 | A | 2/1992 | Armor et al. |
| 5,092,060 | A | 3/1992 | Frachey et al. |
| 5,093,938 | A | 3/1992 | Kamata |
| 5,097,607 | A | 3/1992 | Fredericksen |
| 5,098,124 | A | 3/1992 | Breed et al. |

(56) References Cited

U.S. PATENT DOCUMENTS 5,124,191 A 6/1992 Seksaria
5,131,174 A 7/1992 Drew et al.
5,150,935 A 9/1992 Glance et al.
5,165,990 A 11/1992 Nakano
5,168,576 A 12/1992 Krent et al.
5,175,889 A 1/1993 Infusino
5,204,998 A 4/1993 Liu
5,224,277 A 7/1993 Sang
5,235,715 A 8/1993 Donzis
5,244,745 A 9/1993 Seksaria
5,263,203 A 11/1993 Kraemer et al.
5,271,103 A 12/1993 Darnell
5,274,846 A 1/1994 Kolsky
5,280,890 A 1/1994 Wydra
5,282,288 A 2/1994 Henson
5,324,460 A 6/1994 Briggs
5,330,249 A 7/1994 Weber et al.
5,376,318 A 12/1994 Ho
5,409,200 A 4/1995 Zingher et al.
5,421,035 A 6/1995 Klose et al.
5,423,087 A 6/1995 Krent et al.
5,439,733 A 8/1995 Paire
D364,487 S 11/1995 Tutton et al.
5,477,558 A 12/1995 Volker et al.
5,493,791 A 2/1996 Kramer
5,543,194 A 8/1996 Rudy
5,545,128 A 8/1996 Hayes
5,551,094 A 9/1996 Navone
5,555,584 A 9/1996 Moore et al.
5,572,749 A 11/1996 Ogden
5,572,804 A 11/1996 Skaja et al.
5,581,818 A 12/1996 Lorenzi et al.
5,588,165 A 12/1996 Fromme
5,591,379 A 1/1997 Shores
5,595,003 A 1/1997 Snow
5,598,588 A 2/1997 Lee
5,611,153 A 3/1997 Fisher et al.
5,655,226 A 8/1997 Williams
5,669,079 A 9/1997 Morgan
5,734,994 A 4/1998 Rogers
5,741,568 A 4/1998 Rudy
5,766,704 A 6/1998 Allen et al.
5,891,372 A 4/1999 Besset et al.
5,913,412 A 6/1999 Huber et al.
5,915,537 A 6/1999 Dallas et al.
5,946,734 A 9/1999 Vogan
5,950,244 A 9/1999 Fournier et al.
D415,420 S 10/1999 Chen
5,976,451 A 11/1999 Skaja et al.
5,983,405 A * 11/1999 Casale ..... A42B 3/145 2/417
5,992,054 A 11/1999 Rauch
5,996,126 A 12/1999 Barthold et al.
6,029,962 A 2/2000 Shorten et al.
6,051,624 A 4/2000 Bastin et al.
D424,246 S 5/2000 Ho
D426,032 S 5/2000 Ho
6,070,271 A 6/2000 Williams
6,085,878 A 7/2000 Araki et al.
6,093,468 A 7/2000 Toms et al.
6,098,313 A 8/2000 Skaja
6,105,162 A 8/2000 Douglas et al.
6,105,176 A 8/2000 Egger
6,108,825 A 8/2000 Bell et al.
6,154,889 A 12/2000 Moore, III et al.
6,199,942 B1 3/2001 Carroll et al.
6,219,850 B1 4/2001 Halstead et al.
6,226,801 B1 5/2001 Alexander
6,247,745 B1 6/2001 Carroll et al.
D447,604 S 9/2001 Walters et al.
6,298,497 B1 10/2001 Chartrand
6,326,077 B1 12/2001 Monaci
6,351,854 B1 3/2002 Whalen et al.
6,353,953 B1 3/2002 Tanaka et al.
D455,522 S 4/2002 Royes et al.
6,378,140 B1 4/2002 Abraham
6,381,759 B1 5/2002 Katz
6,383,431 B1 5/2002 Dobrin et al.
6,391,935 B1 5/2002 Hager et al.
6,425,141 B1 7/2002 Ewing et al.
6,434,755 B1 8/2002 Halstead et al.
6,443,513 B1 9/2002 Glance
6,446,270 B1 9/2002 Durr
6,453,476 B1 9/2002 Moore, III
D464,174 S 10/2002 Lu
6,457,261 B1 10/2002 Crary
6,460,207 B1 10/2002 Papay et al.
6,467,099 B2 10/2002 Dennis et al.
6,485,446 B1 11/2002 Brother et al.
6,499,147 B2 12/2002 Schiebl et al.
6,532,602 B2 3/2003 Watters et al.
6,533,258 B2 3/2003 Monson et al.
6,536,052 B2 3/2003 Tao et al.
6,550,850 B2 4/2003 Laborie et al.
D475,486 S 6/2003 Ide et al.
6,604,246 B1 8/2003 Obreja
D481,171 S 10/2003 Ho
6,634,045 B1 10/2003 DuDonis et al.
6,658,671 B1 12/2003 Von Holst et al.
6,671,889 B2 1/2004 Dennis et al.
6,679,544 B1 1/2004 Hubbert et al.
6,679,967 B1 1/2004 Carroll, III et al.
6,681,409 B2 1/2004 Dennis et al.
6,682,128 B2 1/2004 Carroll, III et al.
D491,695 S 6/2004 Long
6,752,450 B2 6/2004 Carroll, III et al.
D492,818 S 7/2004 Ide et al.
D495,096 S 8/2004 Long
6,803,005 B2 10/2004 Dennis et al.
6,926,947 B1 8/2005 Seckel
6,994,333 B2 2/2006 Lobry et al.
D521,191 S 5/2006 Berger
D523,180 S 6/2006 Frye
7,078,443 B2 7/2006 Milliren et al.
D535,059 S 1/2007 Lam
7,178,175 B2 2/2007 Rogers et al.
D541,480 S 4/2007 Turner
7,228,648 B2 6/2007 Yang
7,240,376 B2 7/2007 Ide et al.
7,255,910 B1 8/2007 Seckel
7,299,505 B2 11/2007 Dennis et al.
7,316,036 B2 1/2008 Rudolf et al.
7,338,038 B2 3/2008 Maurer et al.
7,341,776 B1 3/2008 Milliren et al.
7,360,822 B2 4/2008 Carroll, III et al.
D570,055 S 5/2008 Ferrara et al.
7,377,577 B2 5/2008 Carroll, III et al.
7,384,095 B2 6/2008 Cormier
D572,865 S 7/2008 Baker
7,404,593 B2 7/2008 Cormier
D577,866 S 9/2008 Frye et al.
D581,599 S 11/2008 Ferrara et al.
D582,607 S 12/2008 Ferrara et al.
7,458,172 B2 12/2008 Aveni
7,464,414 B2 12/2008 McDuff
D584,456 S 1/2009 Ferrara
7,513,344 B2 4/2009 Toccalino
7,574,760 B2 8/2009 Foley et al.
D603,103 S 10/2009 Ferrara et al.
7,600,268 B2 10/2009 Rogers et al.
7,603,725 B2 10/2009 Harris
7,625,023 B2 12/2009 Audi et al.
D608,688 S 1/2010 Dalzell et al.
7,673,351 B2 3/2010 Copeland et al.
7,676,854 B2 3/2010 Berger et al.
7,677,538 B2 3/2010 Darnell et al.
D617,503 S 6/2010 Szalkowski
D621,099 S 8/2010 Johnson et al.
D622,449 S 8/2010 Culley et al.
7,770,239 B1 * 8/2010 Goldman ..... A42B 3/08 2/415
7,774,866 B2 8/2010 Ferrara
7,802,320 B2 9/2010 Morgan
7,827,617 B2 11/2010 Trainor et al.

(56) References Cited

U.S. PATENT DOCUMENTS

| | | | |
|---|---|---|---|
| 7,857,610 | B2 | 12/2010 | Rossi et al. |
| 7,866,248 | B2 | 1/2011 | Moore et al. |
| 7,895,681 | B2 | 3/2011 | Ferrara |
| D637,356 | S | 5/2011 | Green et al. |
| 7,950,073 | B2 | 5/2011 | Ferrara |
| D640,422 | S | 6/2011 | Green et al. |
| 7,959,023 | B2 | 6/2011 | Ferrara |
| 7,960,473 | B2 | 6/2011 | Kobayashi et al. |
| D645,210 | S | 9/2011 | Chilson et al. |
| 8,039,078 | B2 | 10/2011 | Moore et al. |
| 8,047,602 | B2 | 11/2011 | Sielhorst et al. |
| 8,056,972 | B2 | 11/2011 | Marsden et al. |
| D650,132 | S | 12/2011 | Chilson et al. |
| 8,069,498 | B2 | 12/2011 | Maddux et al. |
| 8,087,187 | B2 | 1/2012 | Aveni et al. |
| 8,104,593 | B2 | 1/2012 | Lin |
| D654,628 | S | 2/2012 | Aris et al. |
| D655,048 | S | 2/2012 | Moeller et al. |
| D655,051 | S | 2/2012 | O'Keefe et al. |
| 8,201,269 | B2 | 6/2012 | Maddux |
| 8,205,272 | B2 | 6/2012 | Green |
| D663,076 | S | 7/2012 | Parsons et al. |
| 8,220,072 | B2 | 7/2012 | Dodd |
| D665,663 | S | 8/2012 | Krupa |
| D666,779 | S | 9/2012 | Harris |
| 8,298,648 | B2 | 10/2012 | Turner |
| 8,348,031 | B2 | 1/2013 | Smaldone et al. |
| 8,353,066 | B2 | 1/2013 | Rogers et al. |
| D677,006 | S | 2/2013 | Pfanner et al. |
| D679,058 | S | 3/2013 | Szalkowski |
| 8,387,164 | B2 | 3/2013 | Maddux et al. |
| 8,399,085 | B2 | 3/2013 | Moore et al. |
| D683,905 | S | 6/2013 | Wills |
| D691,329 | S | 10/2013 | Anderson |
| 8,544,117 | B2 | 10/2013 | Erb |
| 8,561,214 | B2 | 10/2013 | Turner |
| 8,590,869 | B2 | 11/2013 | Tavares et al. |
| 8,702,895 | B2 | 4/2014 | Turner |
| 8,713,719 | B2 | 5/2014 | Turner |
| 8,726,424 | B2 | 5/2014 | Thomas |
| 8,863,320 | B2 | 10/2014 | Kelly |
| 8,950,735 | B2 | 2/2015 | Reynolds |
| 9,066,551 | B2 | 6/2015 | Van Waes |
| 9,131,744 | B2 | 9/2015 | Erb |
| 9,320,311 | B2 | 4/2016 | Szalkowski et al. |
| 2002/0017805 | A1 | 2/2002 | Carroll, III et al. |
| 2002/0023290 | A1 | 2/2002 | Watters et al. |
| 2002/0120978 | A1 | 9/2002 | Moore |
| 2002/0152542 | A1 | 10/2002 | Dennis et al. |
| 2002/0163114 | A1 | 11/2002 | Lobry |
| 2002/0168496 | A1 | 11/2002 | Morimoto et al. |
| 2003/0106138 | A1 | 6/2003 | Guay |
| 2003/0200677 | A1 | 10/2003 | Abraham |
| 2003/0217483 | A1 | 11/2003 | Abraham |
| 2003/0230866 | A1 | 12/2003 | Lee |
| 2004/0117897 | A1 | 6/2004 | Udelhofen |
| 2004/0128860 | A1 | 7/2004 | Smaldone |
| 2004/0139531 | A1 | 7/2004 | Moore et al. |
| 2004/0154191 | A1 | 8/2004 | Park |
| 2004/0188898 | A1 | 9/2004 | Siefermann et al. |
| 2004/0199981 | A1 | 10/2004 | Tucker |
| 2004/0200094 | A1 | 10/2004 | Baychar |
| 2005/0050617 | A1 | 3/2005 | Moore et al. |
| 2005/0060793 | A1 | 3/2005 | Rosie |
| 2005/0166302 | A1 | 8/2005 | Dennis |
| 2005/0196592 | A1 | 9/2005 | Tao et al. |
| 2005/0210567 | A1 | 9/2005 | Rogers et al. |
| 2005/0217006 | A1 | 10/2005 | Sutter et al. |
| 2005/0268383 | A1 | 12/2005 | Harris |
| 2006/0059605 | A1 | 3/2006 | Ferrara |
| 2006/0059606 | A1 | 3/2006 | Ferrara |
| 2006/0064900 | A1 | 3/2006 | Aveni |
| 2006/0070170 | A1 | 4/2006 | Copeland et al. |
| 2006/0101559 | A1 | 5/2006 | Moore et al. |
| 2006/0177635 | A1 | 8/2006 | Pepe et al. |
| 2006/0195974 | A1 | 9/2006 | Burkhart et al. |
| 2007/0000032 | A1 | 1/2007 | Morgan |
| 2007/0083965 | A1 | 4/2007 | Darnell et al. |
| 2007/0089219 | A1 | 4/2007 | Trainor et al. |
| 2007/0190292 | A1 | 8/2007 | Ferrara |
| 2007/0190293 | A1 | 8/2007 | Ferrara |
| 2007/0281125 | A1 | 12/2007 | Moore, III et al. |
| 2008/0035442 | A1 | 2/2008 | Spingler |
| 2008/0036242 | A1 | 2/2008 | Glance et al. |
| 2008/0155735 | A1 | 7/2008 | Ferrara |
| 2008/0166524 | A1 | 7/2008 | Skaja et al. |
| 2008/0236378 | A1 | 10/2008 | Sane et al. |
| 2008/0256686 | A1 | 10/2008 | Ferrara |
| 2008/0307568 | A1 | 12/2008 | Sajic |
| 2009/0038055 | A1 | 2/2009 | Ferrara |
| 2009/0049586 | A1 | 2/2009 | Wirthenstaetter |
| 2009/0106882 | A1 | 4/2009 | Nimmons et al. |
| 2009/0178184 | A1 | 7/2009 | Brine, III et al. |
| 2009/0179361 | A1 | 7/2009 | Vito et al. |
| 2009/0210998 | A1 | 8/2009 | Rolla |
| 2009/0222975 | A1 | 9/2009 | Green et al. |
| 2009/0265841 | A1 | 10/2009 | Ferrara |
| 2009/0289026 | A1 | 11/2009 | Ferrara |
| 2010/0000009 | A1 | 1/2010 | Morgan |
| 2010/0037482 | A1 | 2/2010 | Litchfield et al. |
| 2010/0129573 | A1 | 5/2010 | Kim |
| 2010/0186150 | A1 | 7/2010 | Ferrara et al. |
| 2010/0258988 | A1 | 10/2010 | Darnell et al. |
| 2010/0264571 | A1 | 10/2010 | Tarazona De La Asuncion et al. |
| 2010/0273944 | A1 | 10/2010 | Kobayashi et al. |
| 2010/0295221 | A1 | 11/2010 | Kligerman et al. |
| 2010/0295270 | A1 | 11/2010 | Marsden |
| 2010/0299812 | A1 | 12/2010 | Maddux et al. |
| 2010/0299813 | A1 | 12/2010 | Morgan |
| 2011/0004971 | A1 | 1/2011 | Benderradji |
| 2011/0047678 | A1 | 3/2011 | Barth et al. |
| 2011/0047685 | A1 | 3/2011 | Ferrara |
| 2011/0061154 | A1 | 3/2011 | Turner |
| 2011/0074075 | A1 | 3/2011 | Henry et al. |
| 2011/0094018 | A1 | 4/2011 | Rogers |
| 2011/0107503 | A1 | 5/2011 | Morgan |
| 2011/0131695 | A1 | 6/2011 | Maddux et al. |
| 2011/0167542 | A1 | 7/2011 | Bayne et al. |
| 2011/0198788 | A1 | 8/2011 | Hines |
| 2011/0247744 | A1 | 10/2011 | Turner |
| 2011/0277222 | A1 | 11/2011 | Garneau |
| 2011/0296594 | A1 | 12/2011 | Thomas et al. |
| 2012/0017358 | A1 | 1/2012 | Princip et al. |
| 2012/0036620 | A1 | 2/2012 | Harris |
| 2012/0060251 | A1 | 3/2012 | Schimpf |
| 2012/0079646 | A1 | 4/2012 | Belanger |
| 2013/0152287 | A1 | 6/2013 | Cormier et al. |
| 2013/0239303 | A1* | 9/2013 | Cotterman ..... A42B 3/08 2/417 |
| 2014/0096310 | A1* | 4/2014 | Szalkowski ..... A42B 3/08 2/411 |

FOREIGN PATENT DOCUMENTS

| | | |
|---|---|---|
| CA | 2681439 | 11/2008 |
| CA | 2696242 | 2/2009 |
| CN | 101227842 | 7/2008 |
| CN | 101627222 | 1/2010 |
| CN | 101707885 | 5/2010 |
| CN | 101720999 | 6/2010 |
| CN | 101873811 | 10/2010 |
| DE | 4326049 A1 | 2/1995 |
| EP | 0832572 | 4/1998 |
| EP | 0926990 | 7/1999 |
| EP | 1685019 | 8/2006 |
| EP | 1848293 | 10/2007 |
| EP | 1927294 | 6/2008 |
| EP | 1937466 | 7/2008 |
| EP | 1848293 | 7/2009 |
| EP | 2092210 | 8/2009 |
| EP | 2132516 | 12/2009 |
| EP | 2146177 | 1/2010 |
| EP | 2180802 | 5/2010 |
| ES | 2330138 | 12/2009 |

(56) References Cited

FOREIGN PATENT DOCUMENTS

| | | |
|---|---|---|
| FR | 2717659 | 9/1995 |
| HK | 1112163 | 11/2009 |
| JP | 54-148845 | 11/1979 |
| JP | 2006188771 | 1/2012 |
| SU | 659134 | 4/1979 |
| WO | 91/05489 | 5/1991 |
| WO | 2006/005189 | 1/2006 |
| WO | 2006022679 | 3/2006 |
| WO | 2006/088500 | 8/2006 |
| WO | 2006/089098 | 8/2006 |
| WO | 2006/089235 | 8/2006 |
| WO | 2007/035800 | 3/2007 |
| WO | 2008011708 | 1/2008 |
| WO | 2008/105840 | 9/2008 |
| WO | 2008/140650 | 11/2008 |
| WO | 2009/020583 | 2/2009 |
| WO | 2009/134334 | 11/2009 |
| WO | 2010/087957 | 8/2010 |

OTHER PUBLICATIONS

The Messier Project: The M11 Helmet, 222.cascadeicehockey.com/the-helmet.html (2 pages) Jan. 19, 2010.
The Messier Project: the Technology, www.casecadeicehockey.com/the-technology.html, video slides of the Seven Technology, the video shows 80% compression (2 pages) Jan. 19, 2010.
Schutt Sports: Helmets—HotHead Technology, www.schuttsports.com/aspx/Sport/ProductCatalog.aspx?id-953 (1 page) Jan. 19, 2010.
Technology/SKYDEX, www.skydex.com/technology (3 pages) Jan. 19, 2010.
Blast Limiting/SKYDEX, www.skydex.com/technology/blast_limiting (7 pages) Jan. 19, 2010.
Impact Mitigation/SKYDEX, www.skydex.com/technology/impact_mitigation (7 pages) Jan. 19, 2010.
Manufacturing/SKYDEX, www.skydex.com/technology/manufacturing (2 pages) Jan. 19, 2010.
Development Process/SKYDEX, www.skydex.com/technology/development_process (2 pages) Jan. 19, 2010.
Selection Guide/SKYDEX, www.skydex.com/technology/selection_guide (3 pages) Jan. 19, 2010.
Patent Informaton/SKYDEX, 222.skydex.com/technology/patent (2 pages) Jan. 19, 2010.
Vs. Foam/SKYDEX, www.skydex.com/technology/vs_foam (1 page) Jan. 19, 2010.
Markets & Products/SKYDEX, www.skydex.com/markets_products (3 pages) Jan. 19, 2010.
Military Ballistic Helmet Pads/SKYDEX, www.skydex.com/helmet_pads (6 pages) Jan. 19, 2010.
Body Padding/SKYDEX, www. Wkydex.com/athletic/body_padding (1 page) Jan. 19, 2010.
International Search Report and Written Opinion from International Patent Application No. PCT/US13/63188 dated Mar. 6, 2014.
International Search Report and Written Opinion from International Patent Application No. PCT/US12/059474 dated Jan. 7, 2013.
International Search Report and Written Opinion from International Application No. PCT/US2014/062409, dated Feb. 2, 2015.
Patent Translate Powered by EPO and Google, Description of Translation of JP2006188771, May 2016, Espacenet, pp. 1-15.
Patent Translate Powered by EPO and Google, Description of Abstract of JP2006188771, May 2016, Espacenet, p. 1.
Patent Translate Powered by EPO and Google, Description of Claims of JP2006188771, Jan. 2016, Espacenet, pp. 1-3.
Search Report and Written Opinion from International Application No. PCT/US2011/038870 dated Oct. 26, 2011.
Office Action from U.S. Appl. No. 13/535,767 dated Apr. 18, 2016.
Office Action from U.S. Appl. No. 13/535,767 dated Sep. 2, 2015.
International Search Report and Written Opinion from International Application No. PCT/US2012/059474 dated Jan. 7, 2013.
Search Report from European Patent Application No. 13 844 406.2 dated Jun. 15, 2016.
Office Action from U.S. Appl. No. 13/777,270 dated Jun. 1, 2016.
Response to Office Action dated Jun. 1, 2016 from U.S. Appl. No. 13/777,270 dated Sep. 1, 2016.
Office Action from U.S. Appl. No. 14/254,505, dated Sep. 8, 2016.
Notice of Allowance from U.S. Appl. No. 13/535,767 dated Oct. 21, 2016.
Examination Report No. 1 from Australian Patent Application No. 2013327099 dated Dec. 2, 2016.
Response to Office Action dated Jun. 15, 2016 from European Patent Application No. 13844406.2 dated Dec. 21, 2016.
Office Action from U.S. Appl. No. 13/777,270 dated Jan. 13, 2017.

* cited by examiner

HELMET RETENTION SYSTEM

CROSS REFERENCE TO RELATED APPLICATIONS

This application is a U.S. Non-Provisional patent application which claims priority to U.S. Provisional Patent Application No. 61/896,221, filed on Oct. 28, 2013 and titled "Helmet Retention System," which is hereby incorporated by reference in its entirety.

BACKGROUND

Helmets generally include a shell, liner, and retention system. The helmet shell provides protection from protruding objects and is often configured to spread the impact load across the footprint of the helmet. The helmet liner is generally made of a softer and lower density material than the helmet shell. The helmet liner is often configured such that, upon impact, the helmet liner at least partially absorbs the impact energy from the force of an impact. The helmet retention system is generally configured to retain the helmet on the head of the user.

SUMMARY

The present application discloses a helmet, a retention system for a helmet, and a method of adjusting a helmet.

In certain embodiments, the helmet comprises a helmet shell and a retention system attached to the helmet shell. The retention system comprises a rear portion connected to the rear of the helmet shell, first and second straps extending from the rear portion to a front portion of the helmet shell, and an adjustment device attached to the rear portion for adjusting the length of the first and second straps between the rear portion and the front portion of the helmet shell. Each strap comprises a strap segment and an elongated member attached to the strap segment, and wherein the elongated member is attached to both strap segments. The adjustment device is configured to selectively adjust the elongated member to move the first and second strap segments relative to the helmet shell and adjust the length of the first and second straps between the rear portion and the front portion of the helmet shell to tighten and loosen the straps about the head of the user.

In certain embodiments, the retention system for a helmet comprises a padded portion connected to the rear of the helmet, a pair of first straps extending from the padded portion to right and left temple portions of the helmet, a pair of securing members attached to the right and left temple portions of the helmet, and a lacing device attached to the padded portion and configured to selectively adjust the length of the first straps between the padded portion and the temple portions of the helmet. Each first strap comprises a strap segment extending from the padded portion and a lace portion attached to the strap segment. The lace portion is attached to both strap segments. The securing members movably attach the lace portion to the helmet. The lacing device is configured to selectively adjust the lace portion to move the strap segments relative to the securing members and adjust the length of the first straps between the padded portion and the temple portions of the helmet to tighten and loosen the first straps about the head of the user.

In certain embodiments, the method of adjusting a helmet comprises utilizing a retention system attached to a helmet shell to stabilize a helmet on a user's head. The retention system comprising a rear portion connected to the rear of the helmet shell, first and second straps extending from the rear portion to a front portion of the helmet shell, and an adjustment device attached to the rear portion for adjusting the length of the first and second straps between the rear portion and the front portion of the helmet shell. Each strap comprises a strap segment and an elongated member attached to the strap segment and movable relative to the helmet shell. The elongated member is attached to both strap segments. The method further comprises using the adjustment device to selectively adjust the elongated member and move the first and second strap segments relative to the helmet shell to adjust the length of the first and second straps between the rear portion and the front portion of the helmet shell to tighten and loosen the straps about the head of the user.

Further aspects and concepts will become apparent to those skilled in the art after considering the following description and appended claims in conjunction with the accompanying drawings.

BRIEF DESCRIPTION OF THE DRAWINGS

In the accompanying drawings, which are incorporated in and constitute a part of the specification, embodiments of the invention are illustrated, which, together with a general description of the invention given above, and the detailed description given below, serve to exemplify embodiments of the invention.

DESCRIPTION OF EMBODIMENTS

The present application discloses a helmet, a retention system for a helmet, and a method of adjusting a retention system for a helmet. The retention system generally comprises a rear portion, a plurality of straps, and an adjustment device for adjusting one or more of the straps.

In the embodiments disclosed herein, the retention system is described for use with a military helmet shell. Examples of such military helmet shells include a US Army Advanced Combat Helmet (ACH), a US Marine Corp Lightweight Helmet (LWH), an Enhanced Combat Helmet (ECH), a Personal Armor System for Ground Troops (PASGT) helmet, or other typical ballistic helmet shells. However, the retention system may also be used with a variety of other helmets, including, but not limited to, tactical helmets, aircrew and flight helmets, sporting helmets, such as football, lacrosse, hockey, multi-sport, cycling, whitewater, climbing, softball, or baseball helmets, or safety helmets, such as industrial or construction helmets.

The present application discusses adjustment of the length of straps between two points. Adjustment of the length of a strap between two points means the distance between the two points is adjusted (i.e., increased or decreased). For example, straps between a chin portion and a rear portion of the retention system may be selectively adjusted to increase or decrease the distance between the chin portion and the rear portion. Further, any one or more straps of the present application may comprise one or a plurality of strap segments or other components, such as lacing or wire. For example, a strap between two points may comprise a strap segment and lacing attached to the strap segment. Selective adjustment of the length of the strap, such as, for example, by adjusting the lacing attached to the strap segment, increases or decreases the distance between the two points.

Figure 1:
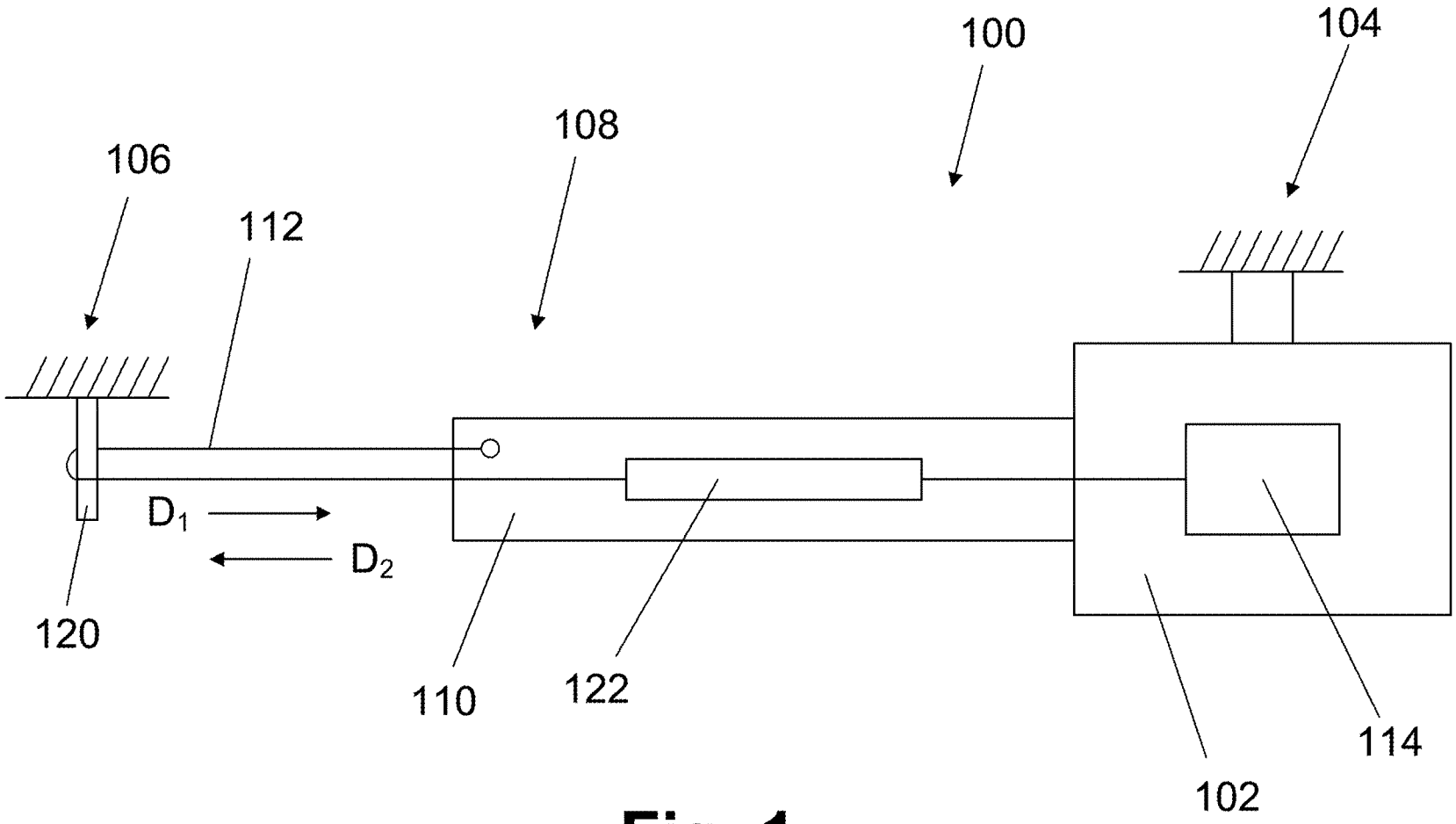
FIG. 1 is a schematic illustrating a helmet retention system according to an embodiment of the present application.

FIG. 1 schematically illustrates a retention system 100 according to an embodiment of the present application. The retention system 100 comprises a rear portion 102 attached to a rear 104 of a helmet shell, at least one flexible strap 108 extending from the rear portion to a front portion 106 of the helmet shell, and an adjustment device 114 attached to the rear portion for adjusting the length of the strap between the rear portion and the front portion of the helmet shell. As shown in FIG. 1, the strap 108 extends from a fixed end 111 to a free end 113. The adjustment device 114 may be a variety of devices capable of adjusting the length of the strap 108, such as, for example, wire, lacing, or belt systems in which a flexible wire, lace, or belt may be adjusted by winding and unwinding, retracting, or otherwise altering the free length of the wire, lace, or belt, or a system with a rigid or semi-rigid strap that can be driven with a rack and pinion gear, worm drive, or other mechanism to alter the free length of the strap. In certain embodiments, the adjustment device 114 is a lacing device.

As illustrated in FIG. 1, the strap 108 comprises a flexible strap segment 110 and a flexible elongated member 112, such as, e.g., a wire, lace, or belt, attached to the strap segment. The elongated member 112 extends from the strap segment 110, through a securing member 120 of the helmet, through an attachment portion 122 of the strap segment, and to the adjustment device 114. The adjustment device 114 is configured to adjust the elongated member 112 by selectively altering the free length of the member. The attachment portion 122 attaches the elongated member 112 to the strap segment 110 and permits the member to move relative to the strap segment. The attachment portion 122 may be shaped and configured in a variety ways, such as, for example, a tube or conduit, one or more eyelets or arches, a sheath, a sleeve, a pocket, a passage, one or more slots or openings in the strap segment, or the like. The elongated member 112 may comprise a variety of materials, including steel, plastic, or fabric. In one embodiment, the elongated member 112 is made from Aircraft grade stainless steel.

When the adjustment device 114 is manipulated to retract the elongated member 112 into the adjustment device, the elongated member is moved in a first direction $D_1$ through the attachment member 122 and the securing member 120. Further, the strap segment 110 is pulled toward the securing member 120. The securing member 120 may be attached directly or indirectly to the helmet. In certain embodiments, the securing member 120 comprises a strap segment that is configured to be attached to the helmet and a clip that movably attaches the elongated member 112 to the strap segment. However, a variety of other means for movably attaching the elongated member to the helmet may be used. For example, in certain embodiments, an opening in the helmet, an opening in a strap segment, an eyelet, a loop, a ring, a clip, a sheath, a sleeve, a passage, a conduit, a buckle, a fastener, or the like may be used to movably attach the elongated member to the helmet.

In certain embodiments, the securing member 120 is attached at the right and/or left front side or temple portion of the helmet. Thus, when the elongated member 112 is retracted into the adjustment device 114, at least a portion of the strap 108 is tightened against the side of the user's head and the rear portion 102 is pulled in a direction forward and upward against the rear of the user's head. Further, the retention system 100 is generally configured with straps 108 extending from the rear portion 102 on both the right and left sides of the helmet. As such, retraction of the elongated members 112 of the right and left straps 108 will fit the retention system 100 around the circumference of the user's head and stabilize the helmet shell on the user's head.

When the adjustment device 114 is manipulated to release the elongated member 112 and permit the member to be pulled out of the adjustment device, the elongated member is permitted to move in a second direction $D_2$ through the attachment member 122 and the securing member 120. Further, the strap segment 110 is permitted to move away from the securing member 120. As such, the strap 108 and the rear portion 102 of the retention system 100 are loosened to facilitate removal of the helmet shell from the user's head. In certain embodiments, the adjustment device 114 may be used to move the elongated member 112 in the second direction $D_2$ through the attachment member 122 and the securing member 120. Further, the adjustment device 114 may be used to move the strap segment 110 away from the securing member 120.

The rear portion 102 of the retention system 100 is generally configured to contact the rear of the user's head, e.g., the occipital or suboccipital portion of the head, and/or the nape of the user's neck and acts as an anchor point of the system. The rear portion may or may not extend below the rear edge of the helmet shell such that it is exposed and accessible to the user when wearing the helmet. The rear portion 102 may also be a variety of shapes and sizes, e.g., the rear portion may be shaped as a truncated triangle, square, rectangle, circle, or any other shape. The rear portion 102 may comprise padding material (e.g., foam) with a canvas covering. However, in certain embodiments, the rear portion may or may not be padded and may include one or more pieces of fabric or polymer material.

In certain embodiments, the retention system of the present application comprises a chin portion, a rear portion, a plurality of straps, and a lacing device for adjusting one or more of the straps. The chin portion is generally configured to receive the chin of a person wearing the helmet. The rear portion is connected to the chin portion and the rear of the helmet. A pair of first straps extend from the chin portion to the rear portion and the length of each first strap between the chin portion and rear portion is selectively adjustable. A pair of second straps extend from the chin portion to the front of the helmet and the length of each second strap between the chin portion and the front of the helmet is selectively adjustable. A pair of third straps extend from the rear portion to the front of the helmet. Each third strap comprises a strap segment and a lace portion attached to the strap segment. The lacing device is attached to the rear portion and configured to selectively adjust the lace portions relative to the lacing device to adjust a length of each third strap between the rear portion and the front of the helmet.

Figure 2A:
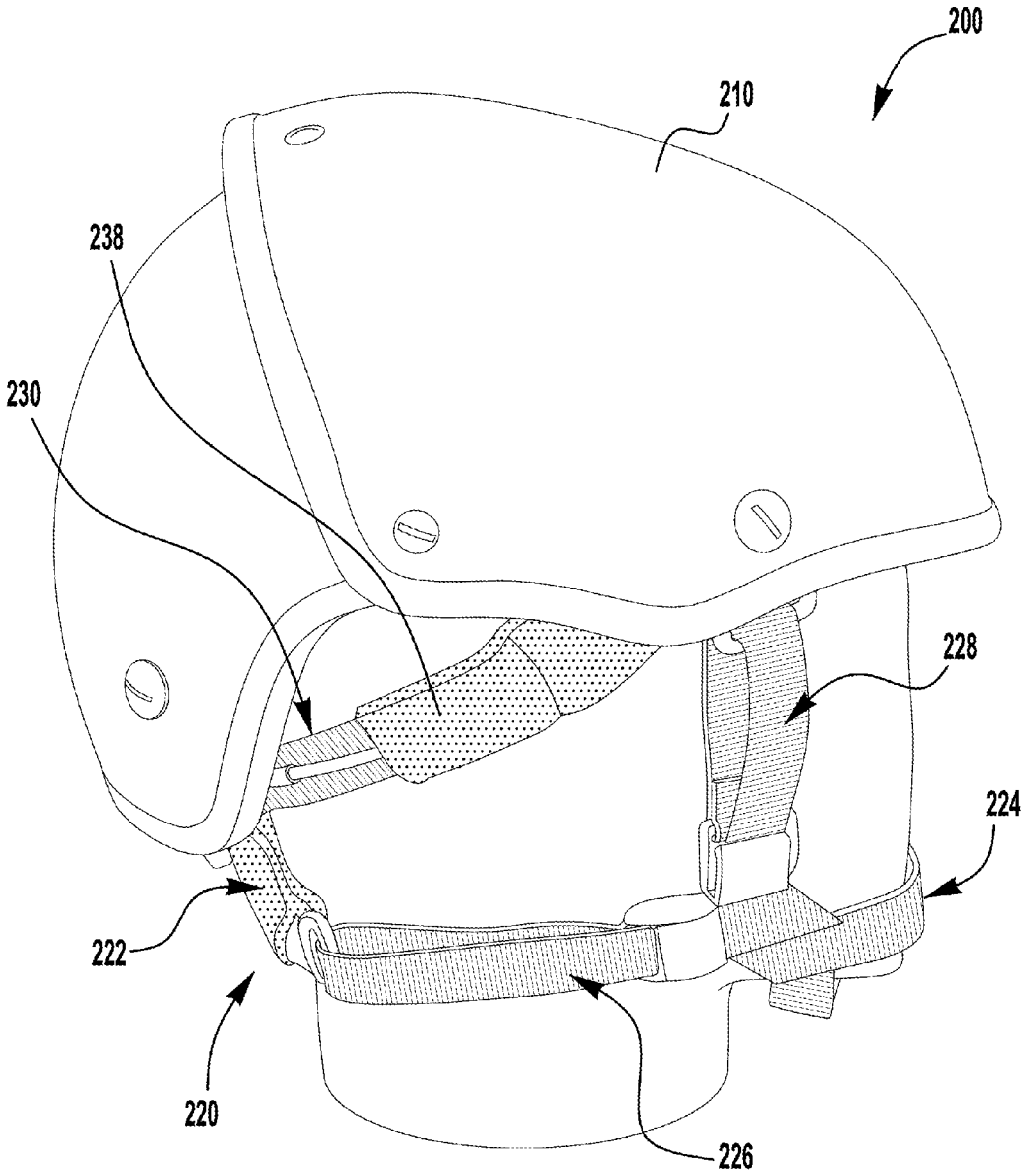
FIG. 2A is a right side view of a helmet having a retention system according to an embodiment of the present application.
Figure 2B:
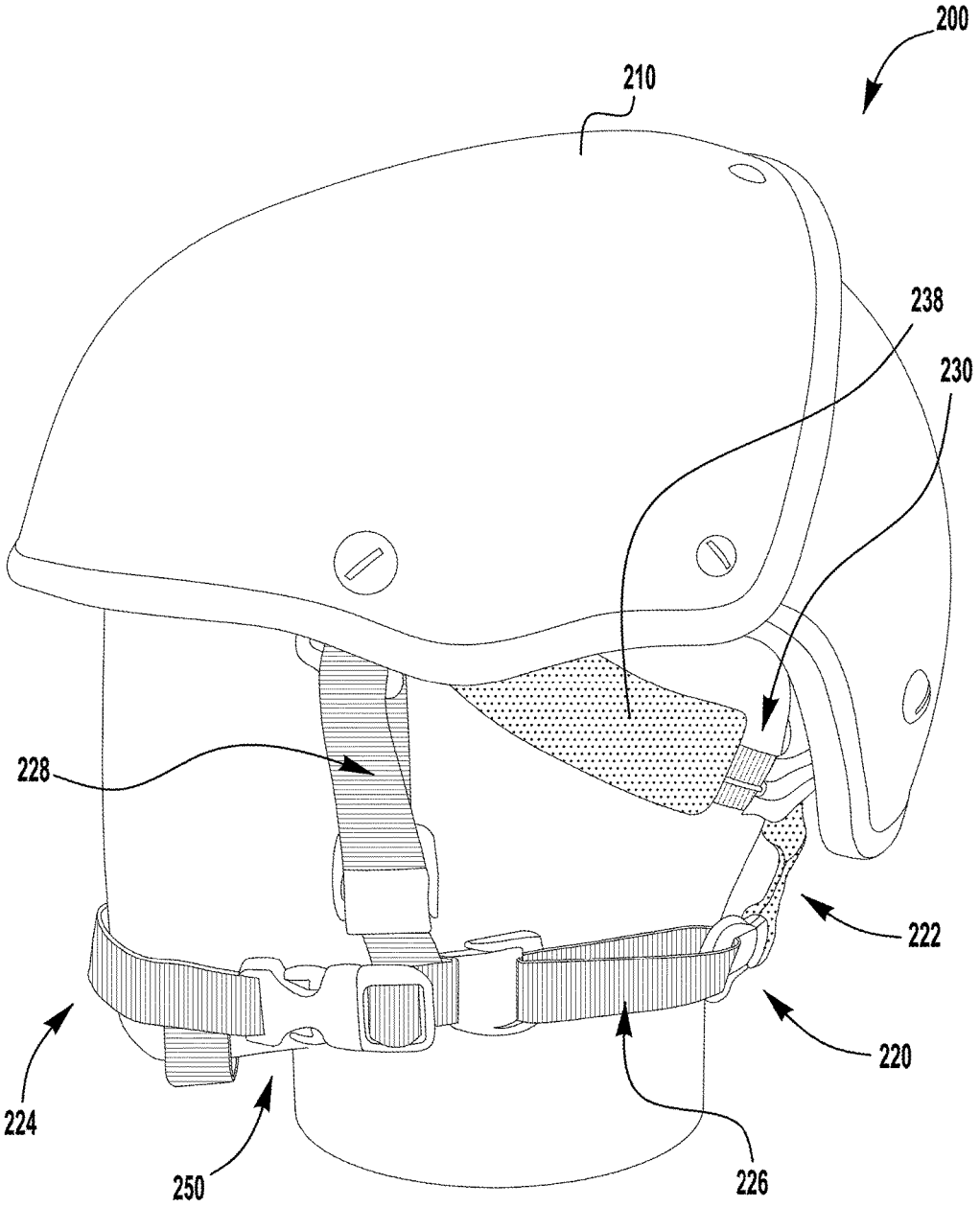
FIG. 2B is a left side view of the helmet of FIG. 2A.
Figure 2C:
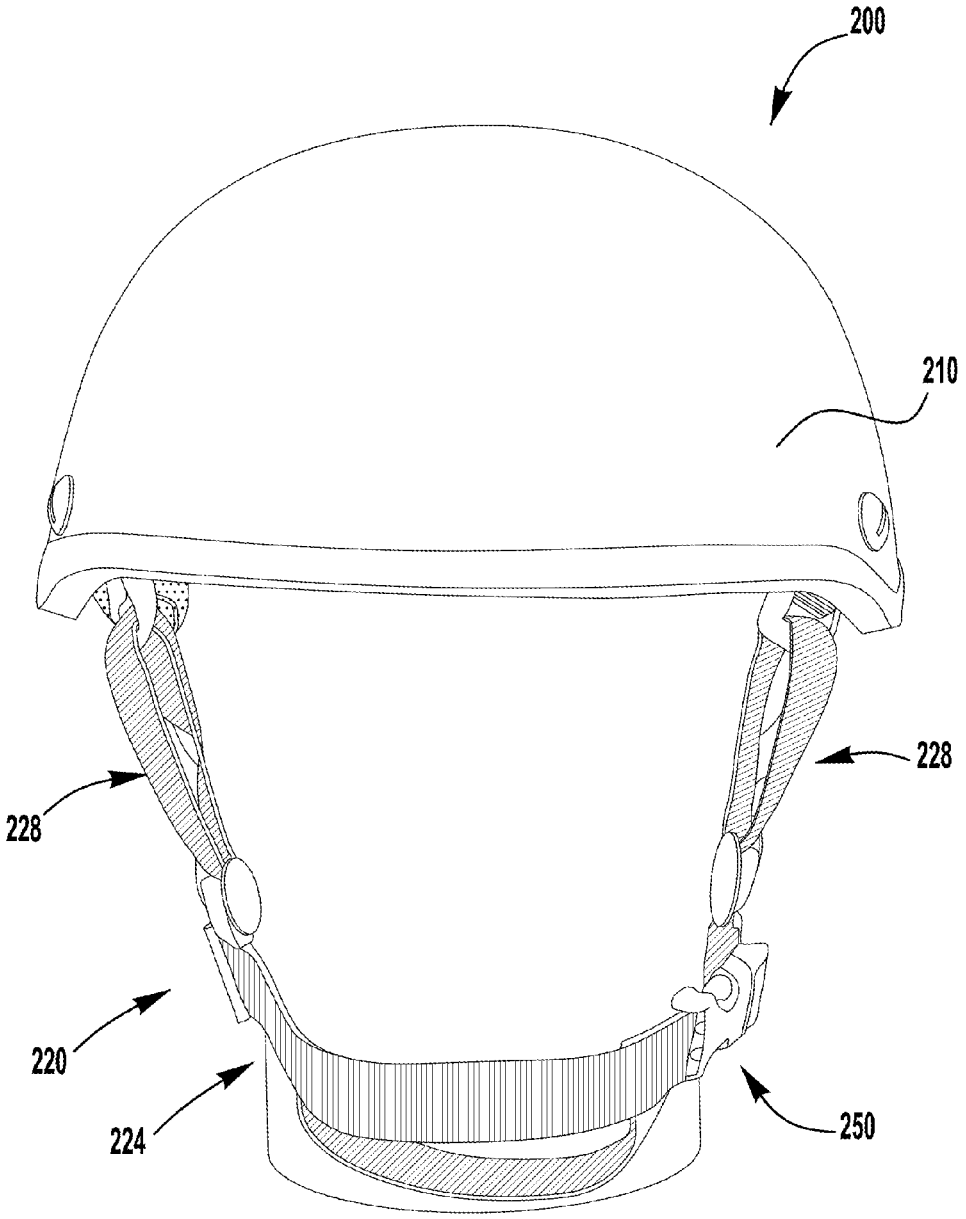
FIG. 2C is a front view of the helmet of FIG. 2A.
Figure 2D:
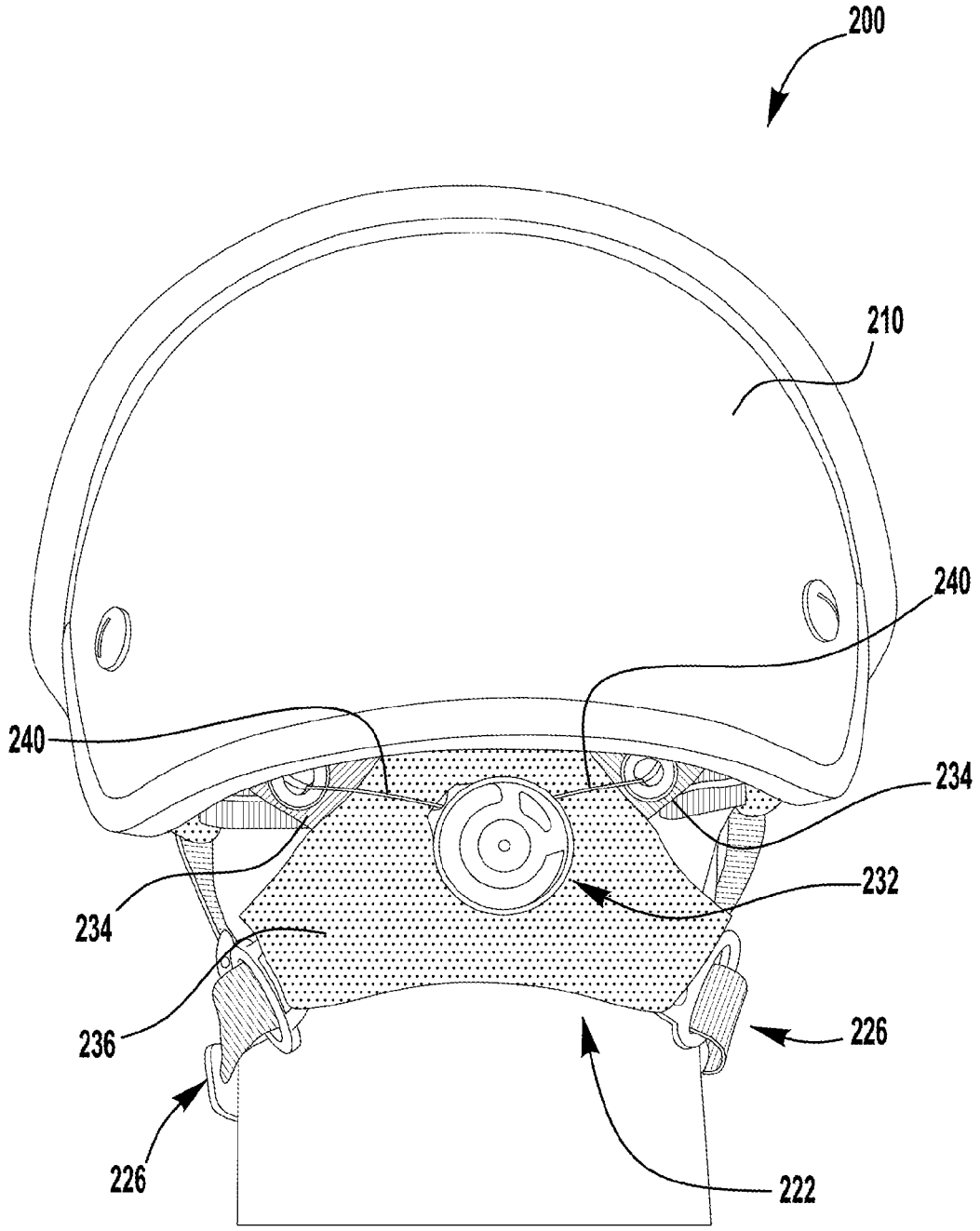
FIG. 2D is a rear view of the helmet of FIG. 2A.

FIGS. 2A-2D illustrate a helmet 200 having a helmet shell 210 and a retention system 220 according to an embodiment of the present application. The retention system 220 is connected to the helmet shell 210 and is configured to hold and stabilize the helmet shell on the user's head. As shown, the retention system 220 comprises a chin portion 224, a rear portion 222, a plurality of straps 226, 228, and 230, and a lacing device 232 (FIG. 2D).

The chin portion 224 of the retention system 220 is configured to receive the chin of the user and acts as a first anchor point of the system. As shown in FIGS. 2A-2C, the chin portion 224 comprises a plurality of flexible straps, or webbing, that are sewn together and are sized and configured to receive the user's chin. However, the chin portion may be configured in a variety of other ways. For example, the chin portion may comprise one or more flexible pieces of fabric or polymer material. Further, the chin portion may comprise a chincup made of one or more components, such as, for example, a polymer or metallic structure formed as a chincup. Further still, the chin portion may comprise a liner material such as ultrasuede or padding material to provide comfort to the user's chin.

The rear portion 222 of the retention system 220 contacts the rear of the user's head, e.g., the occipital or suboccipital portion of the head, and/or the nape of the user's neck and acts as a second anchor point of the system. As shown in FIG. 2D, the rear portion 222 comprises a pad 236 attached to the helmet shell 210 by one or more attachment straps 234 or webbing. At least a portion of the pad 236 extends below the rear edge of the helmet shell 210 such that it is exposed and accessible to the user when wearing the helmet 200. The pad 236 may be a variety of shapes and sizes. As shown in FIG. 2D, the pad 236 is shaped as a truncated triangle with a bottom edge extending substantially the width of the user's neck. The pad 236 comprises a padding material (e.g., foam) with a canvas covering and has a thickness between about 0.1 and 0.5 inches. However, in certain embodiments, the rear portion may or may not be padded and may include one or more pieces of fabric or polymer material.

As illustrated in FIGS. 2A-2D, the retention system 220 comprises a pair of first straps 226, or webbing, connecting the chin portion 224 to the rear portion 222 of the system. The length of each first strap 226 between the chin portion 224 and the rear portion 222 may be selectively adjusted to tighten the rear portion against the user's head and/or neck and the rear of the helmet shell 210 down on the user's head. As illustrated, each first strap 226 comprises a cam lock slider or cam buckle that permits the length of the strap to be selectively adjusted by the user with one hand by pressing down and moving the slider or buckle. However, other strap adjustment devices may be used, such as, for example, various loops, slides, adjusters, clasps, buckles, Velcro®, or other strap adjustment devices. Further, in certain embodiments, one or more of the first straps may not be adjustable and/or may be made of an elastic material.

The retention system 220 also comprises a pair of second straps 228, or webbing, connecting the chin portion 224 to the front of the helmet shell 210. As illustrated in FIGS. 2A-2C, the second straps 228 extend from the chin portion 224 to the right and left front sides or temple portions of the helmet shell 210. The length of each second strap 228 between the chin portion 224 and the front of the helmet shell 210 may be selectively adjusted to tighten the front of the helmet shell down on the user's head. As illustrated, each second strap 228 comprises a cam lock slider or cam buckle that permits the length of the strap to be selectively adjusted by the user with one hand. However, other strap adjustment devices may be used, such as, for example, a loop, slide, adjuster, clasp, buckle, Velcro®, or other strap adjustment device. Further, in certain embodiments, one or more of the second straps may not be adjustable and/or may be made of an elastic material.

The retention system 220 also comprises a pair of third straps 230, or webbing, connecting the rear portion 222 to the front of the helmet shell 210. As illustrated in FIGS. 2A-2B, the third straps 230 extend from the rear portion 222 to the right and left front sides or temple portions of the helmet shell 210. The length of each third strap 230 between the rear portion 222 and the front of the helmet shell 210 may be selectively adjusted to fit the retention system around the circumference of the user's head and stabilize the helmet shell on the user's head. Various strap adjustment devices may be used, such as, for example, a loop, slide, adjuster, clasp, buckle, Velcro®, or other strap adjustment device. Further, in certain embodiments, one or more of the third straps may not be adjustable and/or may be made of an elastic material. As illustrated in FIGS. 2A and 2B, comfort pads 238 at least partially surround a portion of the third straps 230 to provide comfort to the sides of the user's head.

An adjustment device may be used to selectively adjust the length of the third straps 230 between the rear portion 222 and the front of the helmet shell 210. In certain embodiments, the adjustment device is attached to the rear portion 222 and below the rear edge of the helmet shell 210 such that it is exposed and accessible to the user when wearing the helmet. Examples of adjustment devices that may be used include, for example, wire, lacing, or belt systems in which a flexible wire, lace, or belt may be adjusted by winding and unwinding, retracting, or otherwise altering the free length of the wire, lace, or belt, or a system with a rigid or semi-rigid strap that can be driven with a rack and pinion gear, worm drive, or other mechanism to alter the free length of the strap.

As illustrated in FIG. 2D, the adjustment device comprises a wire or lacing device 232 attached to the rear portion 222 below the rear edge of the helmet shell 210. As illustrated, the lacing device 232 is a Boa lacing system, however other adjustable wire, lacing, belt, or strap devices may be used. As described in greater detail below, wires or laces 240 extending from the lacing device 232 are used to selectively adjust the length of the third straps 230 between the rear portion 222 and the front of the helmet shell 210. The wires or laces 240 may comprise a variety of materials, including steel, plastic, or fabric. In one embodiment, the wires or laces 240 are made from Aircraft grade stainless steel.

Figure 3:
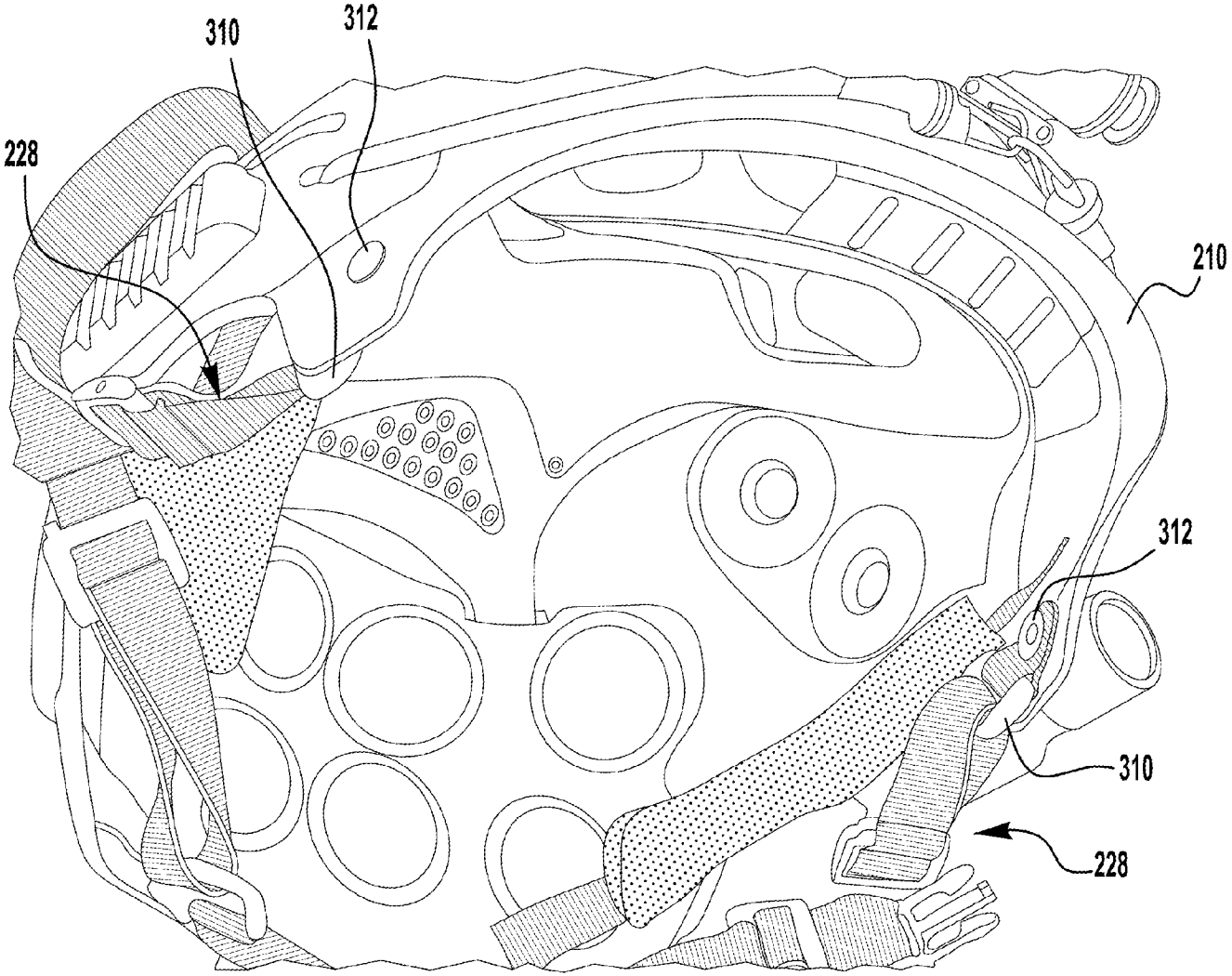
FIG. 3 is a partial bottom perspective view of the inside of a helmet having a retention system according to an embodiment of the present application.

The second, third, and attachment straps 228, 230, and 234 may be attached to the helmet shell 210 in a variety of ways. For example, in certain embodiments, one or more of the straps are attached to a loop or other securing member that is attached to the helmet shell 210 with a fastener, such as a bolt or other fastening device. As an example, FIG. 3 illustrates the second straps 228 attached to a loop 310 that is attached to the helmet shell 210 with a fastener 312. In certain embodiments, a fastener is received through a hole in one or more of the straps to attach the strap directly to the helmet shell. Other methods of attaching the straps to the helmet shell may also be used, such as, for example, by threading the strap through an opening in the helmet shell or by use of an adhesive. Furthermore, any one or more of the second, third, and attachment straps 228, 230, and 234 may be attached to a helmet liner of the helmet shell.

The attachment of any one or more of the second, third, and attachment straps 228, 230, and 234 to the helmet shell 210 may also be adjustable. For example, the loop or other securing member attaching the strap to the helmet shell may be configured such that the distance from the strap attachment point to the helmet attachment point is adjustable. For example, a piece of strap, or webbing, attaching the loop or other securing member to the helmet shell may comprise a plurality of holes that may be used to attach the loop or securing member to the helmet shell. Furthermore, any one or more of the second, third, and attachment straps 228, 230, and 234 may comprise a plurality of holes that may be used to attach the strap directly to the helmet shell.

As illustrated in FIGS. 2B and 2C, the retention system 220 comprises a buckle 250 to permit removal of the retention system and the helmet shell 210 from the head of the user. As illustrated, a first portion of the buckle 250 is attached to the chin portion 224 of the retention system 220 and a second portion of the buckle is attached to the first and second straps 226 and 228 of the retention system. As such, release of the buckle 250 permits the chin portion 224 to be disconnected from the first and second straps 226 and 228 such that the user can remove the helmet 200.

Figure 4A:
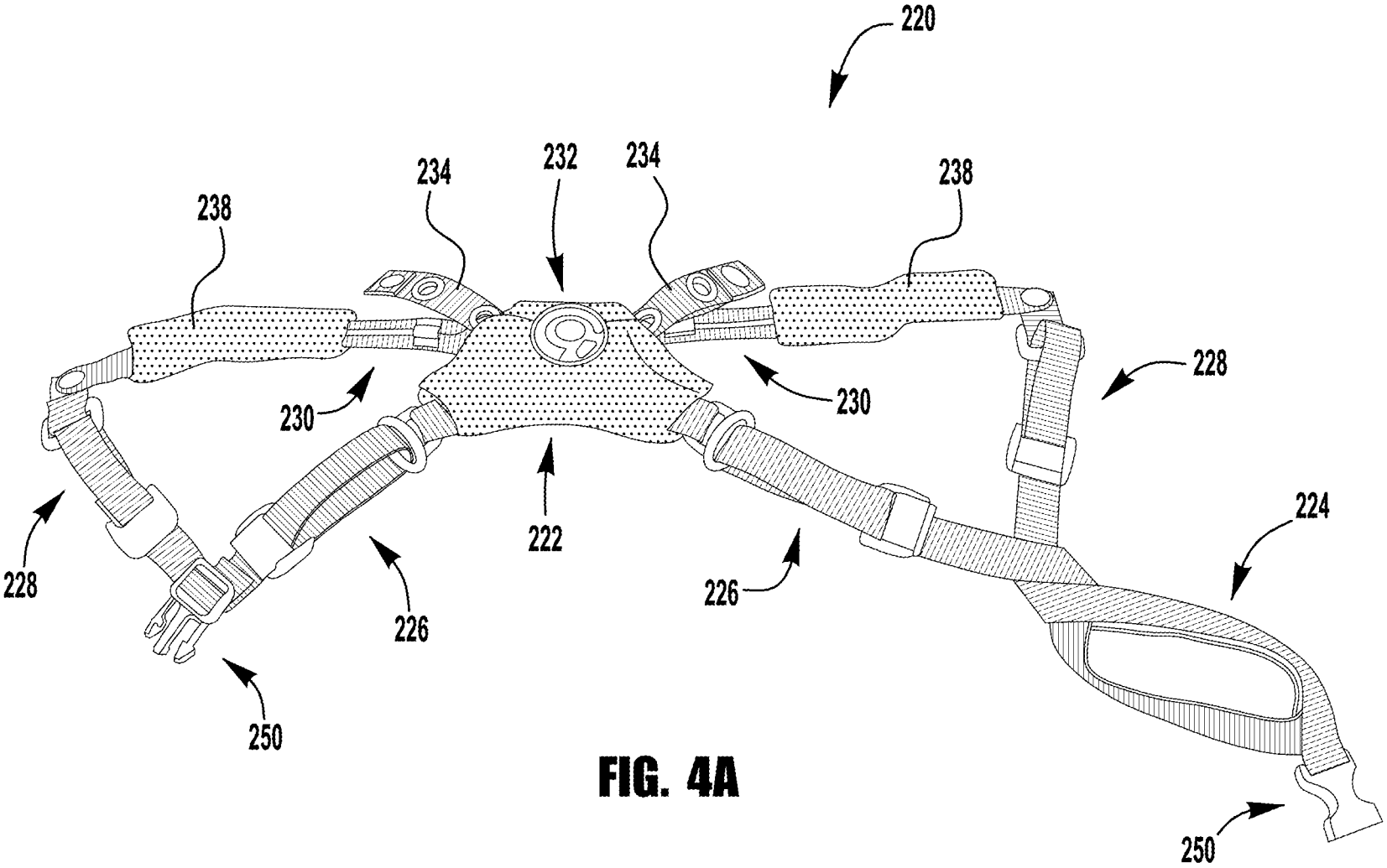
FIG. 4A is a top plan view of the retention system of FIG. 2A removed from the helmet.
Figure 4B:
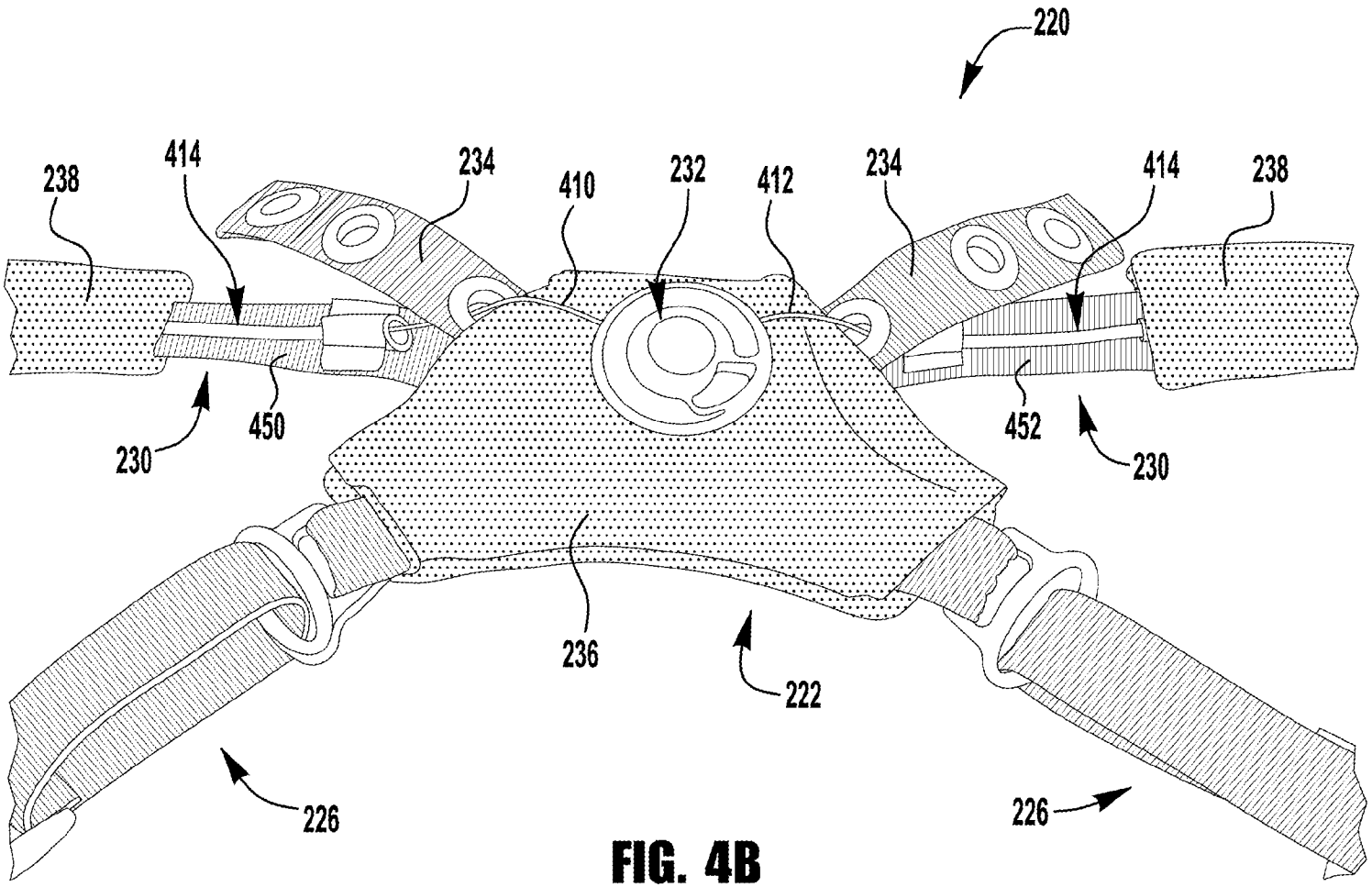
FIG. 4B is a partial top plan view of the retention system of FIG. 4A.
Figure 4C:
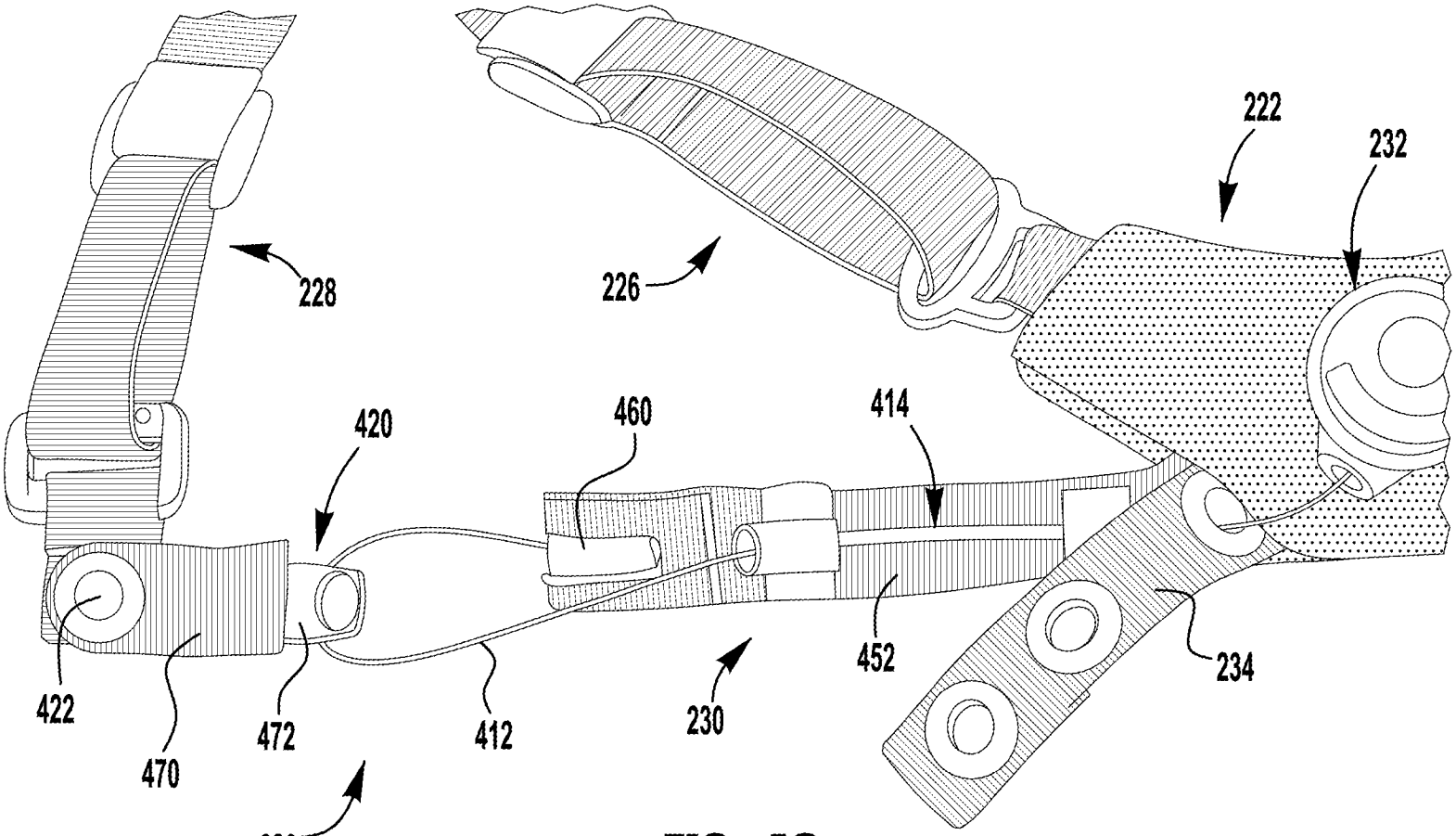
FIG. 4C is a partial top plan view of the retention system of FIG. 4A.

FIGS. 4A-4C illustrate the retention system 220 removed from the helmet shell 210. FIGS. 4A and 4B illustrate the retention system 220 with the comfort pads 238 and FIG. 4C illustrates the retention system with the comfort pads removed.

As illustrated in FIGS. 4A and 4B, first and second lace portions 410 and 412 extend from the lacing device 232 and through openings in the attachment straps 234 of the rear portion 222. The first and second lace portions 410 and 412 are routed through tubes 414 attached to the outer surface of strap segments 450 and 452 of the third straps 230. The tubes 414 movably attach the lace portions 410 and 412 to the strap segments 450 and 452 to permit selective adjustment of the length of each third strap 230 between the rear portion 222 and the front of the helmet shell. However, other means for movably attaching the lace portions to the strap segments may be used. For example, in certain embodiments, one or more eyelets or arches, a sheath, a sleeve, a pocket, a passage or conduit, one or more slots or openings in the strap segment, or the like may be used to movably attach the lace portions to the strap segments.

FIG. 4C illustrates one side of the retention system 220 with the comfort pad removed to better show the connection of the lace portion. Although only one side of the retention system 220 is shown in FIG. 4C, the connection of the lace portion is the same for both sides of the retention system. As shown in FIG. 4C, each third strap 230 extends from a fixed end 231 to a free end 233. Each third strap 230 comprises the strap segment 450 or 452 and the lace portion 410 or 412 attached to the strap segment.

As illustrated in FIG. 4C, the lace portion 412 exits the tube 414 and is routed through a securing member 420 that is configured to be attached to the helmet shell, such as with a fastener inserted through opening 422. The securing member 420 movably attaches the lace portion 412 to the helmet shell to permit selective adjustment of the length of each third strap 230 between the rear portion 222 and the front of the helmet shell. The end of the lace portion 412 is then attached to the strap segment 452 of the third strap 230.

As illustrated in FIG. 4C, the securing member 420 comprises a strap segment 470 that is configured to be attached to the helmet shell and a clip 472 that movably attaches the lace portion 412 to the helmet shell. However, other means for movably attaching the lace portion to the helmet shell may be used. For example, in certain embodiments, an opening in the helmet shell, an opening in a strap segment, an eyelet, a loop, a ring, a clip, a sheath, a sleeve, a passage, a conduit, a buckle, a fastener, or the like may be used to movably attach the lace portion to the helmet shell.

As illustrated in FIG. 4C, the end of the lace portion 412 comprises an enlarged portion 460 that is attached to the strap segment 452 by folding an end of the strap segment over and attaching it to itself to hold the enlarged portion in place. However, a variety of other methods may be used to attach the end of the lace portion 412 to the strap segment 452, such as, for example, by routing the lace portion through an opening in the strap segment or using an adhesive, a loop or other fastening device to secure the lace portion to the strap segment. As illustrated in FIGS. 4A and 4B, the comfort pads 438 are configured to at least partially surround the connection and exposed lace portions 410 and 412 to protect the lace portions and provide comfort to the side of the user's head.

The lacing device 232 may be manipulated to retract the first and second lace portions 410 and 412 into the lacing device (e.g., by rotating a dial of the lacing device). When this occurs, each lace portion 410 and 412 is moved in a first direction through the tube 414 and securing member 420 and the end of the strap segment 450 and 452 is pulled toward the securing member. As illustrated in FIGS. 2A-2C, the securing members are attached at the right and left front sides or temple portions of the helmet shell 210. As such, when the lace portions 410 and 412 are retracted into the lacing device 232, at least portions of the third straps 230 are tightened against the sides of the user's head and the rear portion 222 is pulled in a direction forward and upward against the rear of the user's head to fit the retention system 220 around the circumference of the user's head and stabilize the helmet shell 210 on the user's head.

The lacing device 232 may also be manipulated to release the first and second lace portions 410 and 412 and permit the lace portions to be pulled out of the lacing device (e.g., by pulling up on a dial of the lacing device). When this occurs, each lace portion 410 and 412 is permitted to move in a second direction through the tube 414 and securing member 420 and the strap segment 450 and 452 is permitted to move away from the securing member. As such, the third straps 230 and the rear portion 222 of the retention system 220 are loosened to facilitate removal of the helmet shell 210 from the user's head. In certain embodiments, the lacing device 232 may be used to move the lace portions 410 and 412 in the second direction through the tube 414 and the securing member 420. Further, the lacing device 232 may be used to move the strap segments 450 and 452 away from the securing members 420.

Figure 5:
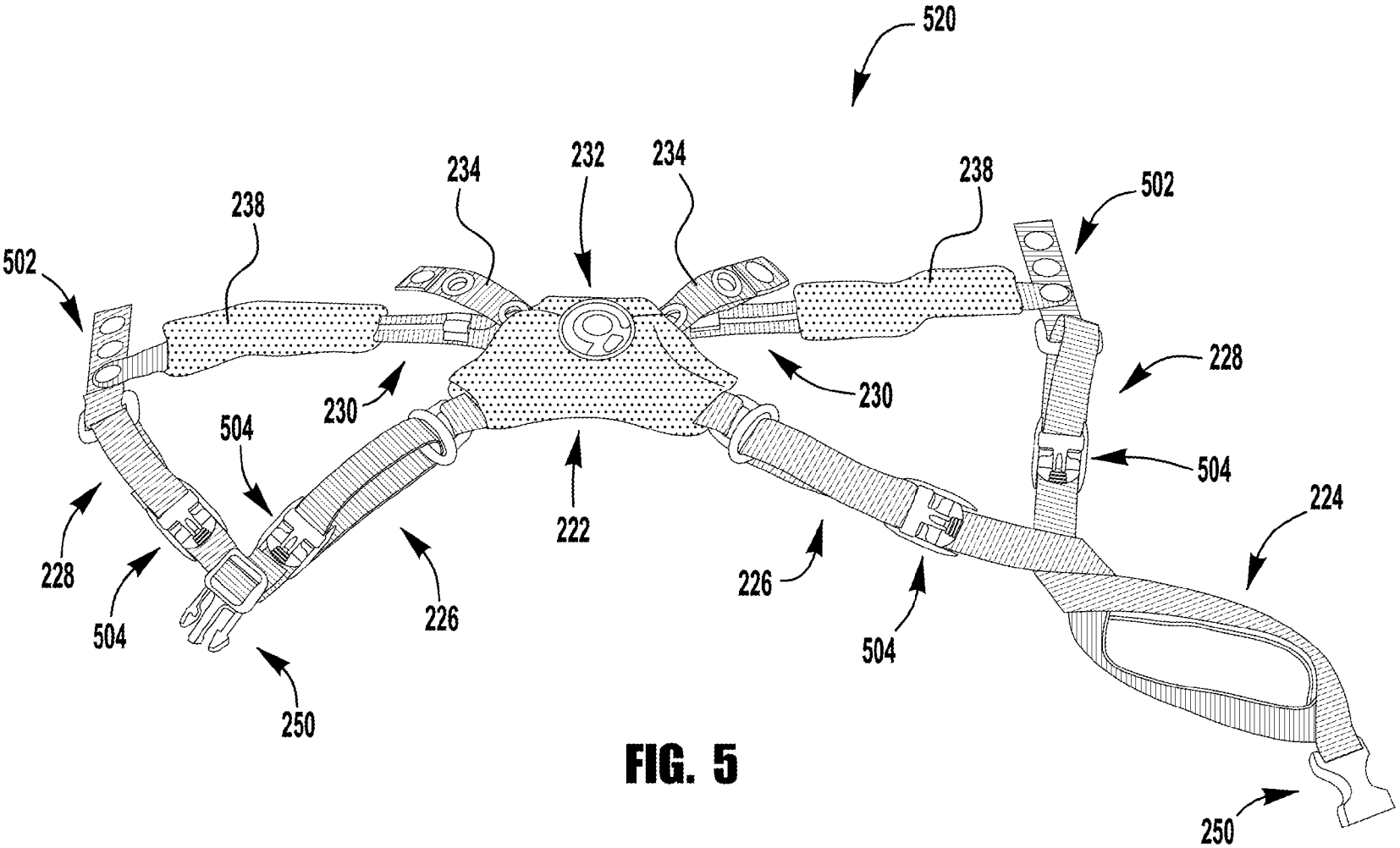
FIG. 5 is a top plan view of a retention system removed from a helmet and according to an embodiment of the present application.

FIG. 5 illustrates a retention system 520 removed from the helmet shell. The retention system 520 is similar to the retention system 220 and, when connected to the helmet shell, is configured to hold and stabilize the helmet shell on the user's head. Similar to retention system 220, the retention system 520 comprises a chin portion 224, a rear portion 222, a plurality of straps 226, 228, and 230, and a lacing device 232. Each first and second strap 226 and 228 of the retention system 520 comprises a cam lock slider or cam buckle 504 that permits the length of the strap to be selectively adjusted by the user with one hand by flipping the top open and moving the slider or buckle. Further, the attachment point of each second and third strap 228 and 230 to the helmet shell is adjustable. As illustrated, an end portion 502 of each second strap 228 comprises a plurality of holes that may be used to attach the second and third straps to the helmet shell.

An exemplary method of adjusting the fit of a helmet on a user's head is described below. A retention system of the present application is attached to a helmet shell to stabilize the helmet on the user's head. In certain embodiments, the retention system comprises a rear portion connected to the rear of the helmet shell, at least one strap extending from the rear portion to a front portion of the helmet shell, and an adjustment device attached to the rear portion. The strap comprises a strap segment extending from the rear portion and an elongated member attached to the strap segment and movable relative to the helmet shell. The adjustment device is used to selectively adjust the elongated member and move the strap segment relative to the helmet shell to adjust the length of the strap between the rear portion and the front portion of the helmet shell.

When the adjustment device is used to move the strap segment in a first or forward direction toward the front portion of the helmet, the strap is tightened against the side of the user's head and the rear portion is pulled in a direction forward and upward against the rear of the user's head to fit the retention system on the user's head and stabilize the helmet shell on the user's head. Further, when the adjustment device is used to move or permit movement of the strap segment in a second or rearward direction away from the front portion of the helmet, the strap and the rear portion are loosened to facilitate removal of the helmet shell from the user's head.

In certain embodiments, the retention system comprises a securing member attached to the front portion of the helmet shell that movably attaches the elongated member to the helmet shell. The adjustment device is used to move the elongated member through the securing member and the strap segment toward the securing member to decrease the length of the strap between the rear portion and the front portion of the helmet shell. Further, the adjustment device is used to permit movement of the elongated member through the securing member and the strap segment away from the securing member to increase the length of the strap between the rear portion and the front portion of the helmet shell.

In certain embodiments, the retention system of the present application comprises an adjustment device and a single elongated member. The elongated member extends from the adjustment device and is movably attached (i.e., attached to a component but able to move relative to the component) to a first strap segment of the retention system, a first securing member of the helmet, a rear portion of the retention system, a second strap segment of the retention system, and a second securing member of the helmet. Adjustment of the adjustment device retracts/releases the elongated member which tightens/loosens the straps and rear portion to fit the retention system on the user's head.

Figure 6:
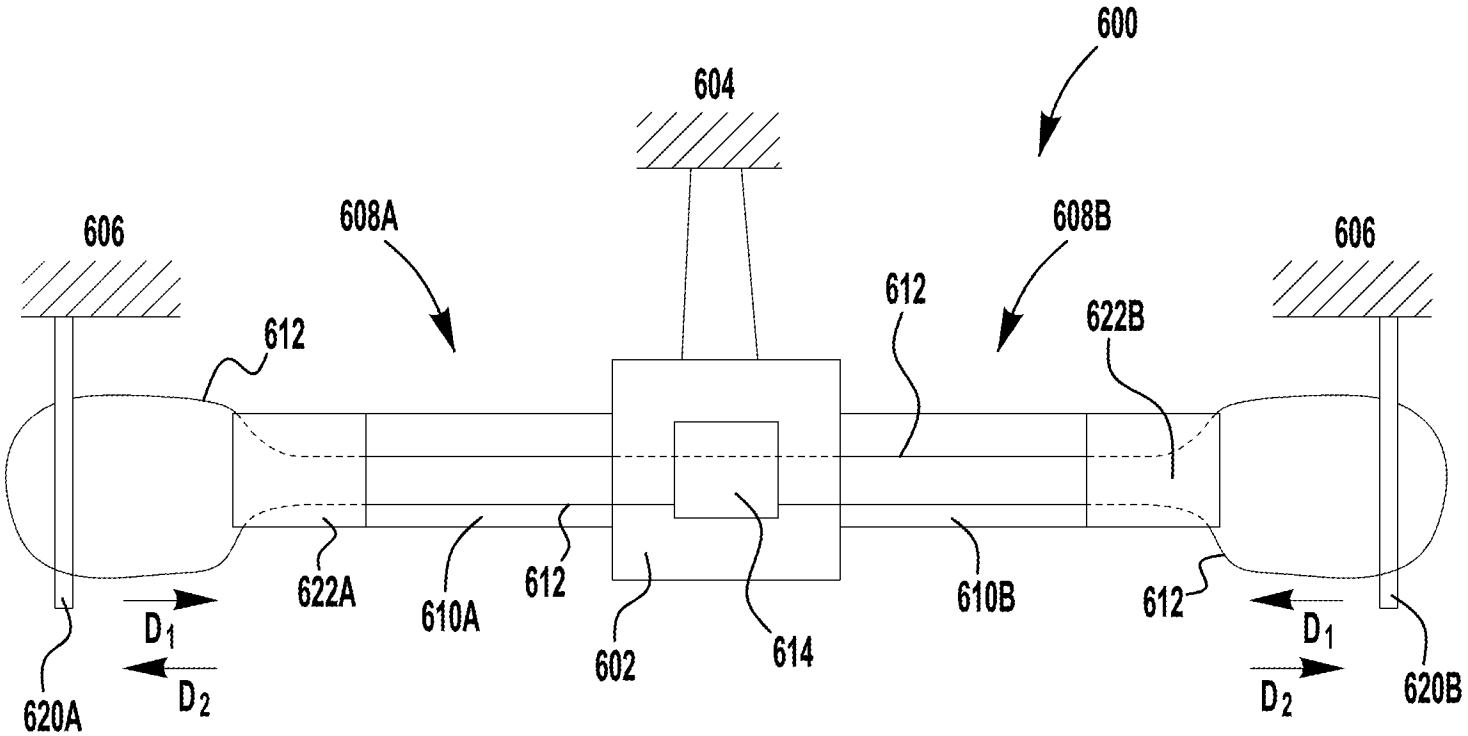
FIG. 6 is a schematic illustrating a helmet retention system according to an embodiment of the present application.

FIG. 6 schematically illustrates a retention system 600 according to an embodiment of the present application. The retention system 600 comprises a rear portion 602 attached to a rear 604 of a helmet shell, flexible straps 608A and 608B extending from the rear portion to a front portion 606 of the helmet shell, and an adjustment device 614 attached to the rear portion for adjusting the length of the straps between the rear portion and the front portion of the helmet shell.

The adjustment device 614 may be a variety of devices capable of adjusting the length of the straps 608A and 608B, such as, for example, wire, lacing, or belt systems in which a flexible wire, lace, or belt may be adjusted by winding and unwinding, retracting, or otherwise altering the free length of the wire, lace, or belt, or a system with a rigid or semi-rigid strap that can be driven with a rack and pinion gear, worm drive, or other mechanism to alter the free length of the strap. In certain embodiments, the adjustment device 614 is a lacing device.

As illustrated in FIG. 6, the straps 608A and 608B comprise flexible strap segments 610A and 610B and a flexible elongated member 612, such as, e.g., a wire, lace, or belt, attached to the strap segment. As shown in FIG. 6, the strap 608A extends from a fixed end 611A to a free end 613A. The strap 608B extends from a fixed end 611B to a free end 613B. The elongated member 612 extends from the adjustment device 614 through a first routing portion 622A of the strap segment 610A, through a first securing member 620A of the helmet, back through the first routing portion 622A, through the rear portion 602, through a second routing portion 622B of the strap segment 610B, through a second securing member 620B of the helmet, back through the second routing portion 622B, and returns to the adjustment device 614. The adjustment device 614 is configured to selectively adjust the elongated member 112 to tighten or loosen the straps 608A and 608B about the head of the user.

The routing portions 622A and 622B are configured to attach the elongated member 612 to the strap segments 610A and 610B and permit the elongated member to move relative to the strap segments. The routing portions 622A and 622B may be located at or near the end of the strap segments 610A and 610B and may be shaped and configured in a variety ways, such as, for example, a tube or conduit, one or more eyelets or arches, a sheath, a sleeve, a pocket, a passage, one or more slots or openings in the strap segment, or the like. In certain embodiments, the routing portions 622A and 622B comprise a double layer of strap bounded by thread stitches and forming a passage for the elongated member 612. The elongated member 612 may comprise a variety of materials, including steel, plastic, or fabric. In one exemplary embodiment, the elongated member 112 is made from Aircraft grade stainless steel.

When the adjustment device 614 is manipulated to retract the elongated member 612 into the adjustment device, the elongated member is moved in a first direction $D_1$ through the routing members 622A and 622B and the securing members 620A and 620B. Further, the strap segments 610A and 610B are pulled toward the securing members 620A and 620B. The securing members 620A and 620B may be attached directly or indirectly to the helmet. In certain embodiments, the securing members 620A and 620B comprise a strap segment that is configured to be attached to the helmet and a clip that movably attaches the elongated member 612 to the strap segment. However, a variety of other means for movably attaching the elongated member to the helmet may be used. For example, in certain embodiments, an opening in the helmet, an opening in a strap segment, an eyelet, a loop, a ring, a clip, a sheath, a sleeve, a passage, a conduit, a buckle, a fastener, or the like may be used to movably attach the elongated member to the helmet.

In certain embodiments, the securing members 620A and 620B are attached at the right and left front side or temple portion of the helmet. Thus, when the elongated member 612 is retracted into the adjustment device 614, at least a portion of the straps 608A and 608B are tightened against the side of the user's head and the rear portion 602 is pulled in a direction forward and upward against the rear of the user's head. Further, the straps 608A and 608B extend from the rear portion 602 on both the right and left sides of the helmet. As such, retraction of the elongated member 612 will fit the retention system 600 around the circumference of the user's head and stabilize the helmet shell on the user's head.

As illustrated in FIG. 6, the elongated member 612 extends through the rear portion 602 to facilitate tightening of the rear portion against the rear of the user's head. However, the elongated member 612 may be movably attached to the rear portion 602 in a variety of different ways such that the elongated member is capable of tightening the rear portion against the rear of the user's head. For example, a tube or conduit, one or more eyelets or arches, a sheath, a sleeve, a pocket, a passage, one or more slots or openings in the rear portion 602, or the like may be used to movably attach the elongated member 612 to the rear portion.

When the adjustment device 614 is manipulated to release the elongated member 612 and permit the member to be pulled out of the adjustment device, the elongated member is permitted to move in a second direction $D_2$ through the routing members 622A and 622B and the securing members 620A and 620B. Further, the strap segments 610A and 610B are permitted to move away from the securing members 620A and 620B. As such, the straps 608A and 608B and the rear portion 602 of the retention system 600 are loosened to facilitate removal of the helmet shell from the user's head. In certain embodiments, the adjustment device 614 may be used to move the elongated member 612 in the second direction $D_2$ through the routing members 622A and 622B and the securing members 620A and 620B. Further, the adjustment device 614 may be used to move the strap segments 610A and 610B away from the securing members 620A and 620B.

Figure 7A:
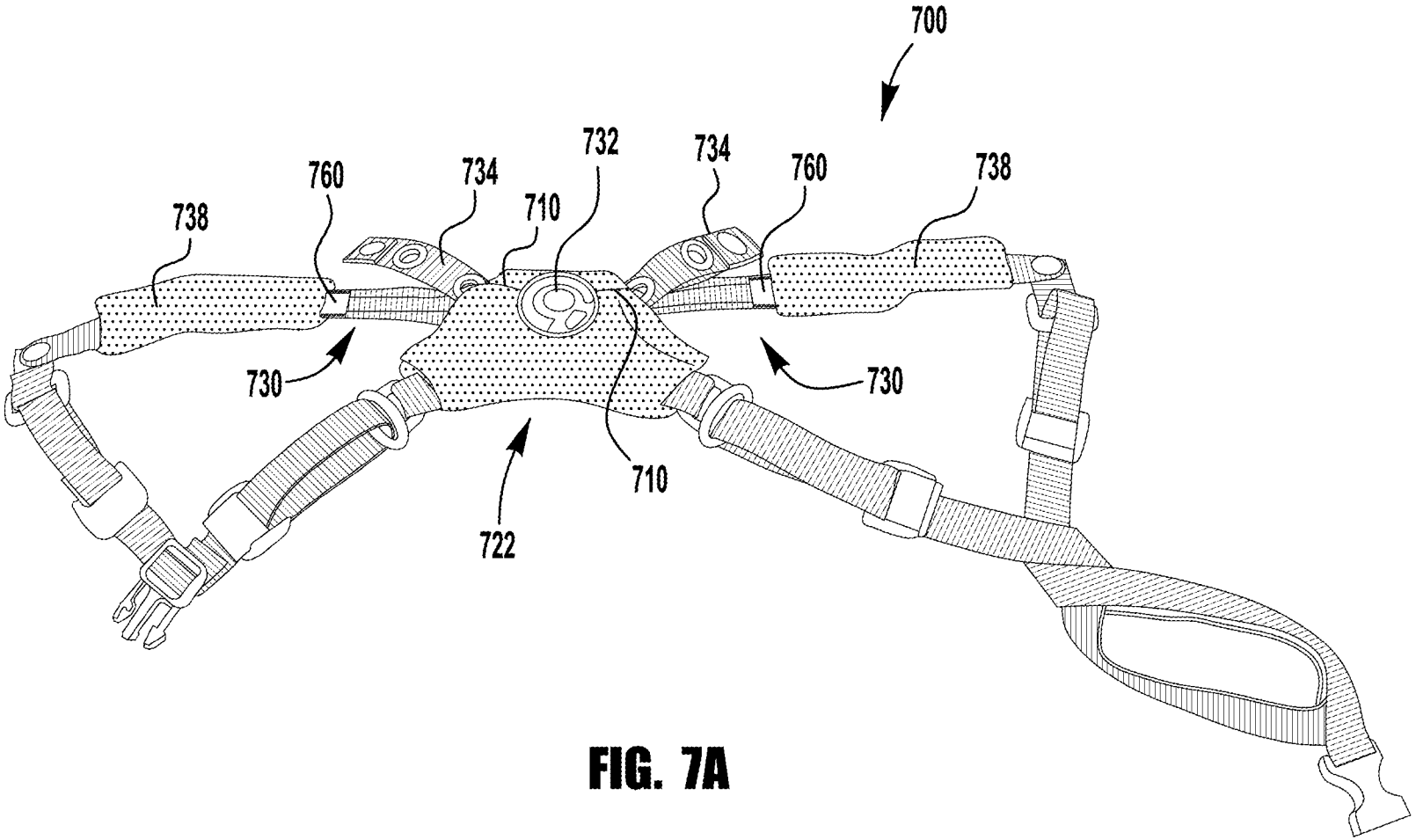
FIG. 7A is a top plan view of a retention system according to an embodiment of the present application removed from a helmet.
Figure 7B:
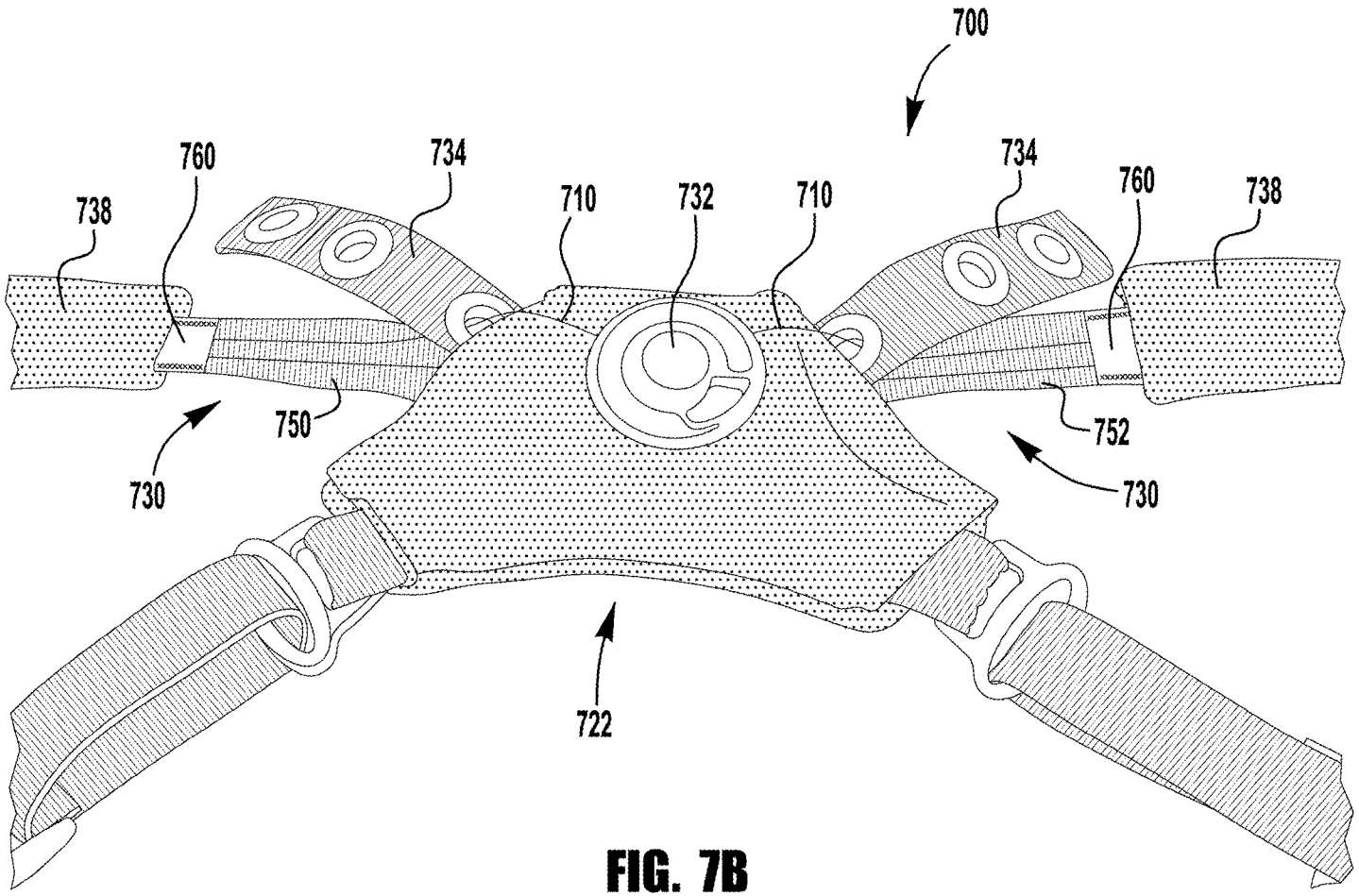
FIG. 7B is a partial top plan view of the retention system of FIG. 7A.
Figure 7C:
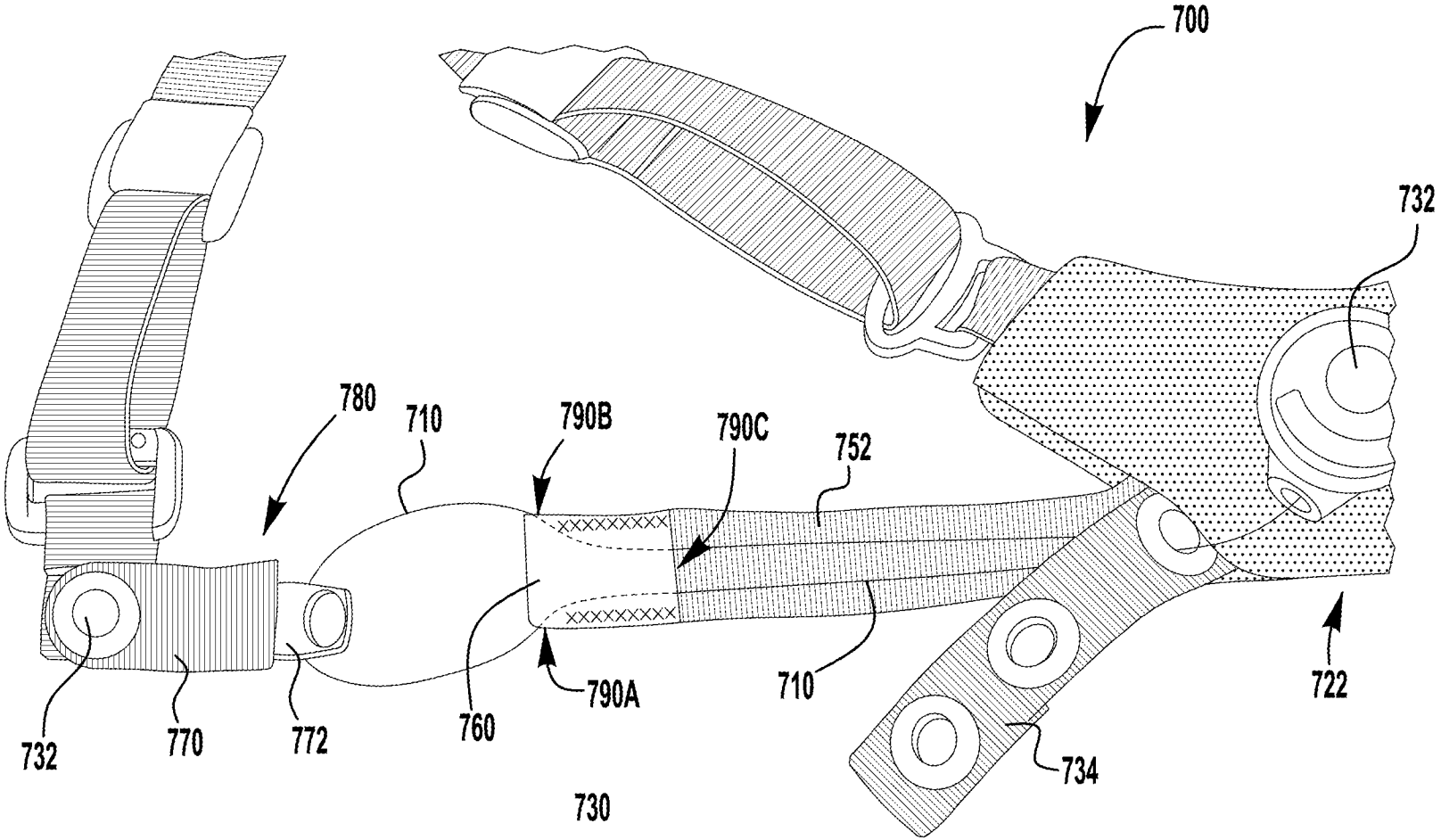
FIG. 7C is a partial top plan view of the retention system of FIG. 7A.

FIGS. 7A-7C illustrate a retention system 700 according to an embodiment of the present application. As shown, the retention system 700 is removed from the helmet shell. FIGS. 7A and 7B illustrate the retention system 700 with comfort pads 738 and FIG. 7C illustrates the retention system with the comfort pads removed.

As illustrated in FIGS. 7A and 7B, a lace portion 710 extends from a lacing device 732 through openings in attachment straps 734 of the rear portion 722. The lace portion 710 extends through routing portions 760 located at an end of strap segments 750 and 752. The routing portions 760 movably attach the lace portion 710 to the strap segments 750 and 752 permitting selective adjustment of the length of each third strap 730 between the rear portion 722 and the front of the helmet shell.

As illustrated in FIGS. 7A-7C, the routing portions 760 form passages for the lace portion 710 by folding the strap segments 750 and 752 over and stitching them together. However, other means for movably attaching the lace portion to the strap segments may be used. For example, in certain embodiments the routing portion may be comprised of one or more eyelets or arches, a sheath, a sleeve, a pocket, a passage or conduit, one or more slots or openings in the strap segment, or the like may be used to movably the lace portion to the strap segments.

FIG. 7C illustrates one side of the retention system 700 with the comfort pad 738 removed to better show the connection of the lace portion 710. Although only one side of the retention system 700 is shown in FIG. 7C, the connection of the lace portion 710 is the same for both sides of the retention system. It should be noted that, for the retention system 700, a single lace portion 710 is used for both sides of the retention system in a single closed loop. Both ends of the lace portion 710 terminate in the lacing device 732. As shown in FIG. 7C, each third strap 730 extends from a fixed end 731 to a free end 733. Further, each third strap 730 comprises the strap segment 750 or 752 and the lace portion 710 movably attached to the strap segment by the routing portion 760.

As illustrated in FIG. 7C, the lace portion 710 originates at the lacing device 732, travels through an opening in the attachment strap 734 and the webbing tunnel or routing portion 760. The lace portion 710 is then routed through a securing member 780 that is configured to be attached to the helmet shell, such as with a fastener inserted through opening 782. The securing member 780 movably attaches the lace portion 710 to the helmet shell to permit selective adjustment of the length of each third strap 730 between the rear portion 722 and the front of the helmet shell. The lace portion 710 is then routed back through the webbing tunnel or routing portion 760 and through the rear portion 722, from which it will emerge on the other side of the retention system 700. The lace portion 710 then travels through the corresponding components on the other side of the retention system 700 and back to the lacing device 732.

As illustrated in FIG. 7C, the securing member 780 comprises a strap segment 770 that is configured to be attached to the helmet shell and a clip 772 that movably attaches the lace portion 710 to the helmet shell. However, other means for movably attaching the lace portion to the helmet shell may be used. For example, in certain embodiments, an opening in the helmet shell, an opening in a strap segment, an eyelet, a loop, a ring, a clip, a sheath, a sleeve, a passage, a conduit, a buckle, a fastener, or the like may be used to movably attach the lace portion to the helmet shell.

As illustrated in FIG. 7C, the routing portion 760 is located at the end of the strap segment 752. The routing portion 760 is configured to movably attach the lace portion 710 to the strap segment 752 such that it constrains the path of the lace portion relative to the strap segment. As shown, the routing portion 760 is formed by folding an end of the webbing strap segment 752 back onto itself and attaching the end to the strap segment in a manner that forms a tunnel or passage having a first opening 790A, a second opening 790B, and a third opening 790C. The lacing portion 710 extends from the lacing device 732, passes into the third opening 790C of the routing portion 760, passes through the passage, exits the first opening 790A, passes through the securing member 780, passes into the second opening 790B, passes through the passage, exits the third opening and extends through the rear portion 722 to the other side of the retention system 700. As such, the lace portion 710 extends through the passage of the routing portion 760 twice on each side of the retention system 700.

However, a variety of other methods may be used to attach the end of the lace portion 710 to the strap segment 752, such as, for example, by routing the lace portion through an opening in the strap segment or using an adhesive, a loop or other fastening device to secure the lace portion to the strap segment. As illustrated in FIGS. 7A and 7B, the comfort pads 738 are configured to at least partially surround the connection and exposed lace portion 710 to protect the lace portion and provide comfort to the side of the user's head.

The lacing device 732 may be manipulated to retract the first and second lace portion 710 into the lacing device (e.g., by rotating a dial of the lacing device). When this occurs, the lace portion 710 is moved in a first direction through the routing portion 760 and securing member 780 and the end of the strap segment 750 and 752 is pulled toward the securing member. The securing members are generally attached at the right and left front sides or temple portions of the helmet shell. As such, when the lace portion 710 is retracted into the lacing device 732, at least portions of the third straps 730 are tightened against the sides of the user's head and the rear portion 722 is pulled in a direction forward and upward against the rear of the user's head to fit the retention system 700 around the circumference of the user's head and stabilize the helmet shell on the user's head.

The lacing device 732 may also be manipulated to release the lace portion 710 and permit the lace portion to be pulled out of the lacing device (e.g., by pulling up on a dial of the lacing device). When this occurs, the lace portion 710 is permitted to move in a second direction through the routing portion 760 and securing member 780 and the strap segment 750 and 752 is permitted to move away from the securing member. As such, the third straps 730 and the rear portion 722 of the retention system 700 are loosened to facilitate removal of the helmet shell from the user's head. In certain embodiments, the lacing device 732 may be used to move the lace portion 710 in the second direction through the routing portion 760 and the securing member 780. Further, the lacing device 732 may be used to move the strap segments 750 and 752 away from the securing members 780.

As described herein, when one or more components are described as being connected, joined, affixed, coupled, attached, or otherwise interconnected, such interconnection may be direct as between the components or may be in direct such as through the use of one or more intermediary components. Also as described herein, reference to a "member," "component," or "portion" shall not be limited to a single structural member, component, or element but can include an assembly of components, members or elements.

While the present invention has been illustrated by the description of embodiments thereof, and while the embodiments have been described in considerable detail, it is not the intention of the applicants to restrict or in any way limit the scope of the invention to such details. Additional advantages and modifications will readily appear to those skilled in the art. For example, component geometries, shapes, and dimensions can be modified without changing the overall role or function of the components. Therefore, the inventive concept, in its broader aspects, is not limited to the specific details, the representative device, and illustrative examples shown and described. Accordingly, departures may be made from such details without departing from the spirit or scope of the applicant's general inventive concept.

While various inventive aspects, concepts and features of the inventions may be described and illustrated herein as embodied in combination in the exemplary embodiments, these various aspects, concepts and features may be used in many alternative embodiments, either individually or in various combinations and sub-combinations thereof. Unless expressly excluded herein all such combinations and sub-combinations are intended to be within the scope of the present inventions. Still further, while various alternative embodiments as to the various aspects, concepts and features of the inventions—such as alternative materials, structures, configurations, methods, devices and components, alternatives as to form, fit and function, and so on—may be described herein, such descriptions are not intended to be a complete or exhaustive list of available alternative embodiments, whether presently known or later developed. Those skilled in the art may readily adopt one or more of the inventive aspects, concepts or features into additional embodiments and uses within the scope of the present inventions even if such embodiments are not expressly disclosed herein. Additionally, even though some features, concepts or aspects of the inventions may be described herein as being a preferred arrangement or method, such description is not intended to suggest that such feature is required or necessary unless expressly so stated. Still further, exemplary or representative values and ranges may be included to assist in understanding the present disclosure, however, such values and ranges are not to be construed in a limiting sense and are intended to be critical values or ranges only if so expressly stated. Moreover, while various aspects, features and concepts may be expressly identified herein as being inventive or forming part of an invention, such identification is not intended to be exclusive, but rather there may be inventive aspects, concepts and features that are fully described herein without being expressly identified as such or as part of a specific invention, the inventions instead being set forth in the appended claims. Descriptions of exemplary methods or processes are not limited to inclusion of all steps as being required in all cases, nor is the order that the steps are presented to be construed as required or necessary unless expressly so stated.

We claim:

1. A helmet, comprising:

a helmet shell; and a retention system attached to the helmet shell, the retention system comprising:

a rear panel connected to a rear portion of the helmet shell;

first and second securing members directly attached to a front portion of the helmet shell;

a first strap having a first fixed end and a first free end, wherein the first fixed end is directly attached to the rear panel;

a second strap having a second fixed end and a second free end, wherein the second fixed end is directly attached to the rear panel;

an elongated member movably attached to the first strap via a first routing portion and the second strap via a second routing portion; and an adjustment device attached to the rear panel of the retention system for adjusting a length of the elongated member;

wherein the adjustment device is configured to selectively adjust the length of the elongated member to move each of the first and second straps relative to the helmet shell and along the elongated member and to tighten and loosen each of the first and second straps about a head of a user by changing a distance between the first and second free ends and the first and second securing members, respectively; and wherein the adjustment device is a lacing device and the elongated member is a single piece of lace, and wherein both ends of the lace terminate at the lacing device.

2. The helmet of claim 1, wherein the first and second securing members each comprise a securing strap segment that is configured to be attached to the helmet and a clip that movably attaches the elongated member directly to the securing strap segment.

3. The helmet of claim 1, wherein the first securing member is attached to a right temple portion of the helmet shell, and the second securing member is attached to a left temple portion of the helmet shell.

4. The helmet of claim 1, wherein the elongated member extends through the rear panel of the retention system to facilitate tightening of the rear panel of the retention system against a rear of the user's head.

5. The helmet of claim 1, wherein the first and second straps are configured to be tightened against a right side and a left side, respectively, of the user's head, and the rear panel of the retention system is configured to be pulled in a direction forward and upward against a rear of the user's head when the elongated member is retracted into the adjustment device.

6. The helmet of claim 1, wherein the elongated member is movably attached to the rear panel of the retention system.

7. The helmet of claim 1, wherein the lace extends from the lacing device through the first routing portion of the first strap, through the first securing member, through the second securing member, through the second routing portion, and returns to the lacing device.

8. The helmet of claim 7, wherein the lace is moved in a first direction through each of the first and second routing portions and each of the first and second securing members when the lace is retracted into the lacing device to:

pull the first and second straps toward the first and second securing members, respectively;

tighten the first and second straps against a right side and a left side of the user's head, respectively; and pull the rear panel of the retention system in a direction forward and upward against a rear of the user's head to fit the retention system around a circumference of the user's head and stabilize the helmet shell on the user's head.

9. The helmet of claim 8, wherein the lace is moveable in a second direction through each of the first and second routing portions and each of the first and second securing members when the lace is released by the lacing device such that the first and second straps are permitted to move away from the first and second securing members, respectively, and the first and second straps are loosened to facilitate removal of the helmet shell from the user's head.

10. The helmet of claim 7, wherein the elongated member extends through the rear panel of the retention system.

11. The helmet of claim 1, wherein the rear panel of the retention system extends below a rear edge of the helmet shell such that it is exposed and accessible to the user when wearing the helmet.

12. The helmet of claim 1, wherein the retention system further comprises comfort pads at least partially surrounding the first and second straps, and the rear panel of the retention system comprises a padding material and a covering.

13. The helmet of claim 1, wherein the retention system comprises:

a chin portion configured to receive a chin of the user wearing the helmet;

a pair of third straps extending from the chin portion to the rear panel of the retention system, wherein the length of each third strap between the chin portion and the rear panel of the retention system is selectively adjustable; and a pair of fourth straps extending from the chin portion to a right front portion and a left front portion of the helmet shell, wherein the length of each fourth strap between the chin portion and the left and right front portions of the helmet is selectively adjustable.

14. The helmet of claim 13, wherein the pair of third straps and the pair of fourth straps are selectively adjustable independent of the first and second straps.

15. The helmet of claim 13, further comprising:

left and right attachment straps extending from the rear panel of the retention system;

wherein the left and right attachment straps connect the rear panel of the retention system to the rear portion of the helmet shell;

wherein the pair of third straps comprises a left third strap and a right third strap;

wherein the left attachment strap and the right third strap extend from opposite locations of the rear panel of the retention system; and wherein the right attachment strap and the left third strap extend from opposite locations of the rear panel of the retention system.

16. The helmet of claim 1, wherein the elongated member is arranged in-line with the first and second straps.

17. The helmet of claim 1, wherein the first and second straps extend from the rear panel of the retention system to a right temple portion and a left temple portion of the helmet shell, respectively.

18. The helmet of claim 1, wherein the helmet shell is selected from the group consisting of a military helmet shell, and a ballistic helmet shell.

19. The helmet of claim 1, wherein the first and second free ends move with the elongated member as the elongated member is adjusted.

20. The helmet of claim 1, further comprising:

left and right attachment straps extending from the rear panel of the retention system; and left and right attachment locations of the rear portion of the helmet shell;

wherein the left and right attachment straps connect the rear panel of the retention system to the left and right attachment locations of the rear portion of the helmet shell, respectively; and wherein the left and right attachment locations are spaced apart greater than a width of the rear panel of the retention system.

21. The helmet of claim 20, wherein the left attachment strap extends from the rear panel proximate the first fixed end and the right attachment strap extends from the rear panel proximate the second fixed end.

22. The helmet of claim 1, wherein each of the first and second straps comprises a continuous piece of material.

23. The helmet of claim 1, wherein the elongated member extends through each of the first and second routing portions twice.

24. The helmet of claim 1, wherein each of the first and second routing portions comprises a passage and at least one opening located at each of the first and second free ends that facilitates movement of the elongated member through the passage, and wherein the elongated member extends through the passage of each of the first and second routing portions twice.

25. A method of adjusting a helmet, comprising the steps of:

utilizing a retention system attached to a helmet shell and configured to stabilize a helmet on a head of a user, the retention system comprising a rear panel connected to a rear portion of the helmet shell, first and second securing members directly attached to a front portion of the helmet shell, a first strap having a first fixed end and a first free end, wherein the first fixed end is directly attached to the rear panel, a second strap having a second fixed end and a second free end, wherein the second fixed end is directly attached to the rear panel, a lace movably attached to the first strap via a first routing portion and the second strap via a second routing portion, and a lacing device attached to the rear panel of the retention system for adjusting a length of the lace; and using the lacing device to selectively adjust the length of the lace to move each of the first and second straps relative to the helmet shell and along the lace, to tighten and loosen each of the first and second straps about the head of the user by changing a distance between the first and second free ends and the first and second securing members, respectively.

26. The method of adjusting a helmet of claim 25, wherein the first and second free ends move with the lace as the lace is adjusted.

27. The method of adjusting a helmet of claim 25, wherein each of the first and second straps comprises a continuous piece of material.

28. The method of adjusting a helmet of claim 25, wherein the lace extends through each of the first and second routing portions twice.

29. The method of adjusting a helmet of claim 25, wherein each of the first and second routing portions comprises a passage and at least one opening located at each of the first and second free ends that facilitates movement of the lace through the passage, and wherein the lace extends through the passage of each of the first and second routing portions twice.

30. A helmet, comprising:

a helmet shell; and a retention system attached to the helmet shell, the retention system comprising:

a rear panel connected to a rear portion of the helmet shell;

first and second securing members directly attached to a front portion of the helmet shell;

a first strap having a first fixed end and a first free end, wherein the first fixed end is directly attached to the rear panel;

a second strap having a second fixed end and a second free end, wherein the second fixed end is directly attached to the rear panel;

an elongated member movably attached to the first strap via a first routing portion and the second strap via a second routing portion;

an adjustment device attached to the rear panel of the retention system for adjusting a length of the elongated member;

wherein the elongated member extends from the adjustment device through each of the first and second routing portions twice; and wherein the adjustment device is configured to selectively adjust the length of the elongated member to move each of the first and second straps relative to the helmet shell and along the elongated member to tighten and loosen each of the first and second straps about a head of a user by changing a distance between the first and second free ends and the first and second securing members, respectively.

31. The helmet of claim 30, wherein each routing portion comprises a passage and at least one opening located at the first free end of the first strap and the second free end of the second strap, respectively, that facilitates movement of the elongated member through the passage.

32. The helmet of claim 30, wherein the retention system comprises:

a chin portion configured to receive a chin of the user wearing the helmet;

a pair of third straps extending from the chin portion to the rear panel of the retention system, wherein the length of each third strap between the chin portion and the rear panel of the retention system is selectively adjustable; and a pair of fourth straps extending from the chin portion to a right front portion and a left front portion of the helmet shell, wherein the length of each fourth strap between the chin portion and the left and right front portions of the helmet is selectively adjustable.

33. The helmet of claim 30, wherein the retention system comprises:

first and second rear attachment locations of the rear portion of the helmet shell; and first and second attachment straps extending from the rear panel of the retention system to connect the rear panel of the retention system to the left and right attachment locations of the rear portion of the helmet shell, respectively.

34. The helmet of claim 33, wherein the elongated member extends through a first opening in the first attachment strap and a second opening in a second attachment strap.

35. A helmet, comprising:

a helmet shell; and a retention system attached to the helmet shell, the retention system comprising:

a rear panel connected to a rear portion of the helmet shell;

a first strap having a first fixed end and a first free end, wherein the first fixed end is directly attached to the rear panel;

a second strap having a second fixed end and a second free end, wherein the second fixed end is directly attached to the rear panel;

an elongated member movably attached to the first strap via a first routing portion and the second strap via a second routing portion;

an adjustment device attached to the rear panel of the retention system for adjusting a length of the elongated member; and first and second securing members directly attached to a front portion of the helmet shell, each of the first and second securing members comprising a securing strap segment that is configured to be attached to the helmet and a clip that moveably attaches the elongated member directly to the securing strap segment;

wherein the adjustment device is configured to selectively adjust the length of the elongated member to move each of the first and second straps relative to the helmet shell and along the elongated member and to tighten and loosen each of the first and second straps about a head of a user by changing a distance between the first and second free ends and the first and second securing members, respectively.

36. A helmet, comprising:

a helmet shell; and a retention system attached to the helmet shell, the retention system comprising:

a rear panel connected to a rear portion of the helmet shell;

first and second securing members directly attached to a front portion of the helmet shell;

a first strap having a first fixed end and a first free end, wherein the first fixed end is directly attached to the rear panel;

a second strap having a second fixed end and a second free end, wherein the second fixed end is directly attached to the rear panel;

an elongated member movably attached to the first strap via a first routing portion and the second strap via a second routing portion;

an adjustment device attached to the rear panel of the retention system for adjusting a length of the elongated member;

a chin portion configured to receive a chin of a user wearing the helmet;

a pair of third straps extending from the chin portion to the rear panel of the retention system, wherein the length of each third strap between the chin portion and the rear panel of the retention system is selectively adjustable; and a pair of fourth straps extending from the chin portion to a right front portion and a left front portion of the helmet shell, wherein the length of each fourth strap between the chin portion and the left and right front portions of the helmet is selectively adjustable;

wherein the adjustment device is configured to selectively adjust the length of the elongated member to move each of the first and second straps relative to the helmet shell and along the elongated member and to tighten and loosen each of the first and second straps about a head of the user by changing a distance between the first and second free ends and the first and second securing members, respectively.

* * * * *